US010829872B2

(12) United States Patent
Wang et al.

(10) Patent No.: US 10,829,872 B2
(45) Date of Patent: Nov. 10, 2020

(54) COMPOSITE MATERIALS WITH SELF-REGULATED INFRARED EMISSIVITY AND ENVIRONMENT RESPONSIVE FIBERS

(71) Applicant: UNIVERSITY OF MARYLAND, COLLEGE PARK, College Park, MD (US)

(72) Inventors: Yuhuang Wang, Laurel, MD (US); Min Ouyang, Rockville, MD (US); Chuanfu Sun, College Park, MD (US); Yongxin Wang, College Park, MD (US); Shangjie Yu, College Park, MD (US)

(73) Assignee: University of Maryland, College Park, College Park, MD (US)

( * ) Notice: Subject to any disclaimer, the term of this patent is extended or adjusted under 35 U.S.C. 154(b) by 874 days.

(21) Appl. No.: 15/159,666

(22) Filed: May 19, 2016

(65) Prior Publication Data

US 2016/0376747 A1 Dec. 29, 2016

Related U.S. Application Data

(60) Provisional application No. 62/164,020, filed on May 20, 2015, provisional application No. 62/295,865, filed on Feb. 16, 2016.

(51) Int. Cl.

| | |
|---|---|
| ***D06N 7/00*** | (2006.01) |
| ***D03D 1/00*** | (2006.01) |
| ***D06M 10/00*** | (2006.01) |
| ***D06M 11/74*** | (2006.01) |
| ***D03D 15/00*** | (2006.01) |
| ***D03D 9/00*** | (2006.01) |

(Continued)

(52) U.S. Cl.

CPC ..... *D03D 1/00* (2013.01); *D03D 9/00* (2013.01); *D03D 15/00* (2013.01); *D06M 10/003* (2013.01); *D06M 10/06* (2013.01); *D06M 11/74* (2013.01); *D06M 15/285* (2013.01)

(58) Field of Classification Search

None

See application file for complete search history.

(56) References Cited

U.S. PATENT DOCUMENTS

2003/0035951 A1* 2/2003 Magill ..... D01F 1/10 428/373

2008/0057809 A1* 3/2008 Rock ..... A41D 31/0038 442/64

(Continued)

*Primary Examiner* — Shawn Mckinnon

*Assistant Examiner* — Lashawnda T Mckinnon

(74) *Attorney, Agent, or Firm* — Rosenberg, Klein & Lee

(57) ABSTRACT

A composite fabric having self-regulating Infrared emissivity includes meta fibers formed with optical nanostructures and an environment (temperature and/or moisture) responsive mechanism configured to adjust a relative disposition between the optical structures to control the electromagnetic coupling therebetween, thus regulating the infrared emissivity of the composite fabric to maintain a user of the fabric in a temperature/moisture comfort zone. The environment responsive mechanism may include a temperature responsive polymer layer on the fiber capable of expansion/shrinkage depending on the applied temperature, or a moisture responsive fiber changing its shape depending on the moisture level to affect spacing between the optical nanostructures.

16 Claims, 15 Drawing Sheets

(51) Int. Cl.
*D06M 15/285* (2006.01)
*D06M 10/06* (2006.01)

(56) References Cited

U.S. PATENT DOCUMENTS

2008/0300349 A1* 12/2008 Fuchikami ..... C08G 63/6926
524/117
2010/0255303 A1* 10/2010 Wardle ..... B82Y 10/00
428/378
2010/0276072 A1* 11/2010 Shah ..... B82Y 30/00
156/184
2013/0090030 A1* 4/2013 Van De Vyver ..... D02G 3/441
442/111

* cited by examiner 5.0kV 16.1mm x200 SE(M) 200 μm 10.0kV 16.1mm x200 SE(M) 200 μm

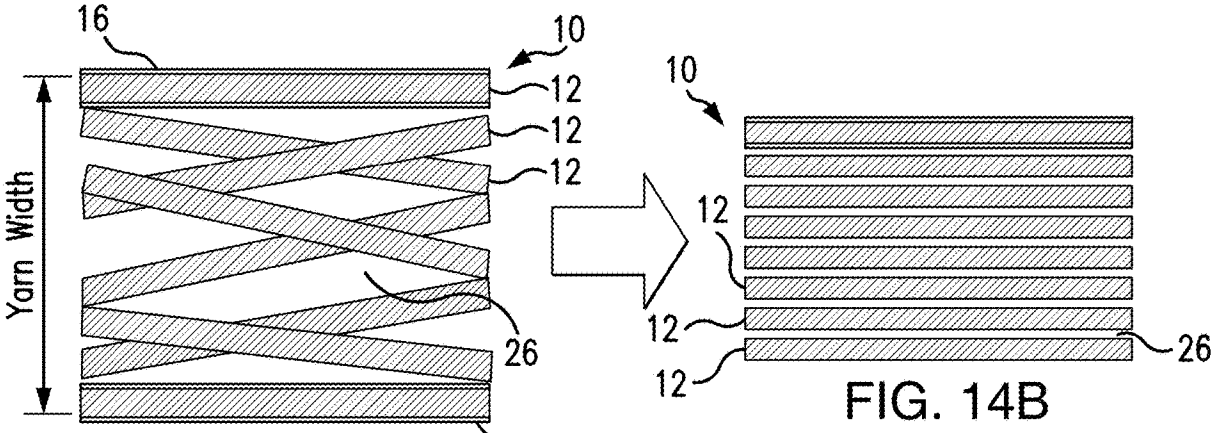
FIG. 14A
FIG. 14B
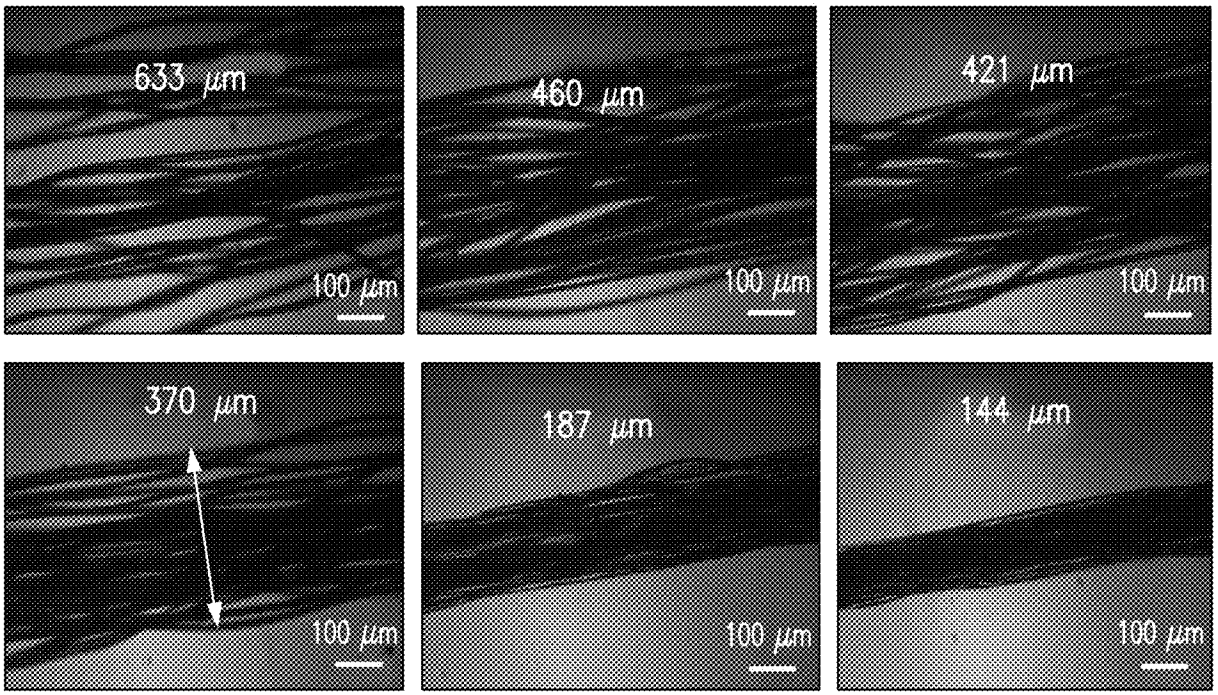
FIG. 14C

COMPOSITE MATERIALS WITH SELF-REGULATED INFRARED EMISSIVITY AND ENVIRONMENT RESPONSIVE FIBERS

STATEMENT REGARDING FEDERAL SPONSORED RESEARCH OR DEVELOPMENT

This invention was made with government support under DEAR0000527 awarded by DOE ARPA-E. The government has certain rights in the invention.

REFERENCE TO THE RELATED APPLICATION(S)

This Utility Patent Application is based on the Provisional Patent Applications No. 62/164,020 filed on 20 May 2015 and No. 62/295,865 filed on 16 Feb. 2016.

FIELD OF THIS INVENTION

The present invention is directed to energy saving and environmentally responsive smart materials, and more in particular to composite materials capable of self-regulation of the surface infrared emissivity.

More in particular, the present invention is directed to a Local Thermal Management System (LTMS) which is based on a composite material manufactured with climate-responsive fibers cooperating to attain a tunable infrared emissivity of the composite fabric for the active self-regulation of heat (and/or moisture) transfer in response to a deviation from a predetermined temperature and/or moisture zone.

Moreover, the present invention is directed to a wearable technology which is based on composite materials manufactured by interconnecting fibers, yarns, or thin films formed with optical structures, and temperature and/or a moisture responsive mechanism configured to dynamically change a relative disposition between the optical structures. This modulates an electromagnetic coupling therebetween, to dynamically adjust the infrared emissivity of the composite materials to a level sufficient to maintain the temperature and/or moisture in a wearer's comfort zone.

BACKGROUND OF THE INVENTION

There are vast commercial interests in developing energy saving and environmental responsive materials.

On-body wearable clothing technologies that permit expanding the temperature set point of air-conditioning in areas of interest (for example, in an enclosure occupied by wearers of such clothing, in office, residential, industrial, etc. settings,) by as little as ±4° F. can reduce the energy consumption by over 20%. This energy saving amounts to more than 1% of the energy consumed in the United States.

Energy saving can be even higher in environments different than buildings, or residential and office areas. For example, in automobiles where thermal insulation is poorer compared to buildings, the energy saving due to the use of environmentally responsive fabric may be much higher.

The energy saving and environmentally responsive materials may also serve the clothing temperature regulation requirements in severe working environments, such as, for example, battle fields, and in the wild, where effective regulation of body temperature and keeping wearers of the clothing in the local climate comfort zone is extremely important for their survival.

The importance of the wearable Local Thermal Management Systems (LTMS) technology is well recognized as, for example, evident from Tao, X., *Smart Fibres, Fabrics and Clothing*, Woodhead Publishing. Cambridge, 2001; and Law, T., *The future of thermal comfort in an energy-constrained-world*. Springer: 2013. Commercial products using LTMSs are currently presented by air-conditioned jackets and various cooling vests that remove heat from a wearer through evaporation of water. Unfortunately, these products are only suitable for indoor use, especially in an office setting, due to their poor aesthetics and bulkiness. In addition, these products may suffer excessive stress as a result of increased indoor humidity.

Examples of other state-of-the-art textiles include Nike's Sphere React™ Mitsubishi Rayon's Ventcool™ textiles, and Polartec's™ series of advanced textiles that use perspiration responsive fabric designed to maintain skin dry by increasing air spaces in the textiles to promote sweat wicking. However, none of these technologies are capable of the active regulation of infrared emissivity, and no fabric (or textile) is available which can offer a tunable infrared emissivity that can be used to self-regulate heat transfer in response to thermal discomfort.

Infrared (IR) clothing is commercially available that incorporates nanoparticles to enhance absorption of infrared radiation for hyperthermia therapy. However, the existing technology, being a passive technology, cannot self-regulate heat transfer.

It would be highly desirable to provide a new type of composite materials capable of active self-regulation of the infrared emissivity of the fabrics (textiles) to offer a self-maintained comfort zone for the users of the composite materials.

SUMMARY OF THE INVENTION

It is therefore an object of the present invention to provide composite materials capable of active self-regulation of the infrared emissivity to maintain a temperature comfort zone for the users of the composite materials.

It is another object of the present invention to overcome shortcomings of the currently available wearable technologies by extending the skin's thermoregulation capabilities and by harnessing the human body's absorption and heat releasing mechanism, to attain a dynamically tunable infrared emissivity of the wearable technologies to maintain comfort zone for the user.

It is an additional object of the present invention to provide a novel composite material using a meta-cooling textile (MCT) which is capable of modulating infrared (IR) emissivity of the textile in response to thermal discomfort, thus providing the temperature regulation in an autonomous and self-powered fashion.

Furthermore, it is an object of the present invention to harness the mechanism of the IR radiation heat transfer as a primary channel for energy exchange between the body of the composite material wearer and the environment for the localized thermal management incorporated in wearable items.

It is a further object of the present invention to provide a meta-cooling textile (MCT) and meta-cooling fibers for heat/moisture self-regulation which synergistically integrate a reversible tuning of the IR emissivity and material porosity control for regulation of air convection and perspiration absorption and for evaporative cooling (when needed) of items made from MCT.

It is still an object of the present invention to provide energy saving and environmentally responsive smart composite materials for variable applications, such as for example, on-body wearable temperature responsive clothing technologies, sport clothing, medical and military clothing, fabrics for shelters and undercoverings, interiors of automobiles, airplanes, and ships, etc., where rapid cooling/heating and body perspiration regulation are desirable, as well as wearable technologies for severe working environments (such as, for example, battle fields and the wild), where an effective regulation of body temperature is required.

The present invention is also directed to meta fibers having optical nanostructures bonded thereto and coated with a thermally responsive polymer, which, depending on the temperature exposure, shrinks or expands, to modulate the distance between optical nanostructures on neighboring meta fibers, resulting in controllable electromagnetic coupling between the optical nanostructures, defining the IR emissivity of the composite textile. The thermal properties of the textile are thus self-regulated depending on the temperature of the environment.

It is a further object of the present invention to provide a meta-cooling textile (MCT) designed to afford temperature control beyond skin's thermoregulation capabilities by modulating infrared emissivity of on-body wearable clothing in response to thermal discomfort, where MCT wearable items are formed from meta fibers, formed with base fibers coated with (or incorporating) meta elements, a relative interposition of which in the textile (MCT) determines the IR emissivity of the MCT and is controllable through various mechanisms.

The present invention is also directed to a textile formed from yarns arranged in an array, where each yarn is formed from meta fibers covered in the optical (metal) structures, where distance between the fibers is changed either by a thermally responsive polymer covering the fiber and has the capability of shrinking or expanding in accordance with the applied temperature, or by forming the meta fibers with moisture responsive properties capable of changing the relative interposition between the optical structures depending on the applied moisture, thus effectively changing interposition of the optical structures to tune the IR emissivity.

The present invention is also directed to meta-cooling fibers and textile formed from such meta-cooling fibers, where the coating with meta elements (such as, for example, carbon nanotubes) are applied to the fibers for modifying the fibers to achieve meta material properties where the electromagnetic properties can be manipulated.

In addition, it is an object of the present invention to provide a composite textile formed from meta fibers covered with optical structures and thermally responsive polymer, wherein, when the body temperature exceeds a predetermined comfort temperature, the thermally responsive polymer layer shrinks, bringing the optical structures (on the fibers within the yarn) closer each to the other, thus inducing resonant electromagnetic coupling therebetween that shifts the peak emissivity of the textile to maximally match the emissivity of the body surface. Shrinkage within the fibers also causes increase of the physical openings between the yarns and reduction of the fabric thickness, resulting in lowering of the fabric resistance, thus promoting the convective and conductive heat and moisture transfer.

Another object of the present invention is to provide a composite material capable of a reversible self-thermoregulation process, which, upon the temperature falling below a comfort level, dictates the expansion of the thermally responsive polymer, and consecutive increase of distances between optical structures on neighboring meta fibers, followed by reduction of openings between the yarns in the fabric, resulting in decreased heat and moisture transfer to keep the wearer in a comfort zone.

It is a further object of the present invention to provide a composite MCT fabric available in different embodiments, where one of the designs uses a 3-layer meta fiber, where each fiber is coated with a thin layer of nanostructure, such as carbon nanotubes (CNTs), subsequently covered with beads of temperature responsive polymers, as well as formed with bi- or multiple-component yarns comprising CNT coated meta fibers, that produce a different environmental response. This generates a resonant electromagnetic (EM) coupling therebetween when exposed to temperatures exceeding a predetermined temperature, or manifesting an EM decoupling when exposed to temperature levels below the predetermined temperature.

It is another object of the present invention to provide a manufacturing process for producing a meta-cooling fiber, where a melted polymer is formed into individual monofilament/fiber, which is subsequently drawn through a bath of CNT solution, treated by microwave radiation to bond the CNT nanostructures firmly to the fiber surface. This forms a CNT/fiber composite which is subsequently passed through a bath of PNP solution to provide a thin film of the PNP solution which is absorbed on the fiber surface. This eventually separates into beads on the fiber to produce the meta-cooling fiber. The meta-cooling fibers subsequently are interwoven in the MCT yarn/fabric composite material for further applications in clothing, sport, textile, etc., industries.

It is an additional object of the present invention to provide meta-cooling fibers and textiles having thermally responsive properties and using moisture responsive fibers operating synergistically to improve moisture and heat comfort self-management of wearable items.

It is a further object of the present invention to provide a composite material with self-regulated infrared emissivity based on bimorph fibers responsive to moisture/humidity and covered by a thin layer of meta elements and thermo-responsive polymer beads whose local structure changes depending on temperature and humidity acting in a reversible manner to provide bi-directional (reversible) thermal regulation as well as moisture responsiveness.

In one aspect, the present invention is directed to a composite fabric with self-regulated infrared emissivity which is formed with a plurality of environment responsive meta fibers positioned in a spaced-apart relationship each with respect to the other. The meta fabrics are arranged in a number of yarns. A respective first distance exists between respective neighboring meta fibers in a yarn. The yarns are arranged in an array, thus forming the subject composite fabric, where the yarns are spaced each from the other by a second distance between the neighboring yarns.

Each meta fiber includes:

a base fiber, an optical structure coated on the surface of the base fiber or embedded therein, thus forming an optical structure-fiber composition, and an environment responsive mechanism operatively coupled to the optical structure-fiber composition and configured to change interposition between the optical structures in the composite fabric. In this manner, the IR emissivity of the composite fabric is regulated as required to withstand deviation of the temperature (or moisture) from the comfort zone.

In one embodiment, the environment responsive mechanism includes a temperature responsive polymer layer coated on the optical structure-fiber composition.

An electromagnetic coupling between the optical structures on the neighboring meta fibers determines an infrared emissivity of the composite fabric.

When a temperature applied to the meta fibers deviates from a predetermined (comfort) temperature zone, the thickness of the temperature responsive polymer layer changes, thus affecting the first distance between the neighboring meta fibers. This controls the electromagnetic coupling between the optical structures for adjusting the infrared emissivity of the composite fabric as required to maintain the thermal comfort zone.

Specifically, when the applied temperature exceeds the predetermined temperature zone (comfort zone), the temperature responsive polymer layer shrinks, thus decreasing the respective first distance between the neighboring meta fibers (in the yarn), and thus increases the infrared emissivity due to the resonant electromagnetic coupling between the optical structures on the neighboring meta filters. In addition, the second distance between the neighboring yarns in the fabric is increased, resulting in increasing the air convection through the composite fabric between the neighboring yarns, with the result of enhanced heat release to reduce the applied temperature to the comfort zone.

The self-regulation process attained in the subject composite fabric is a reversible process, i.e., when the applied temperature falls below the predetermined temperature (comfort) zone, the temperature responsive polymer layer expands, thus increasing the respective first distance between the neighboring meta fibers in the yarn, which decreases the infrared emissivity due to a diminished electromagnetic coupling between the optical structures of the neighboring meta fibers and decreases the respective second distance between the neighboring yarns, which has the effect of decreasing the air convection through the composite fabric between the neighboring yarns.

The optical structure may be in the form of a thin layer of 10-20 nm thickness, which may include carbon nanotubes (CNT), carbon nanohorns, carbon fibers, graphene, graphene oxides, silver nanowires, copper nanowires, silicon nanowires, gold nanowires, gold nanoparticles, conductive nanomaterials, and thin films, surfactant stabilized aqueous solutions of CNTs, as well as any combinations thereof.

The temperature responsive polymer may include poly (N-isopropylacrylamide), hydroxypropyl cellulose, poly(vinylcaprolactame), polyvinyl methyl ether, polyethylene oxide, polyvinylmethylether, polyhydroxyethylmethacrylate, poly(N-acryloylglycinamide), ureido-functionalized polymers, copolymers from N-vinylimidazole and 1-vinyl-2-(hydroxylmethypimidazole, copolymers from acrylamide and acrylonitrile, and derivatives thereof, and combinations thereof. A protection coating may also cover the temperature responsive polymer layer.

In another aspect, the present invention is directed to a composite fabric with self-regulated infrared emissivity, which is formed from a plurality of environment-responsive bimorph meta fibers arranged in a number of yarns. Yarns are positioned in a predetermined spaced-apart array-like relationship each with respect to another. A first distance is established between respective neighboring bimorph meta fibers within a respective yarn, and a second distance is established between respective neighboring yarns.

Each bimorph meta fiber includes a moisture responsive core fiber formed at least from a hydrophilic material part and a hydrophobic part as well as an optical structure coated on the core fiber.

An electromagnetic coupling between the optical structures on neighboring bimorph meta fibers determines an infrared emissivity of the composite fabric at a predetermined temperature and moisture zone (comfort zone).

When the moisture and temperature applied to the composite fabric exceeds the temperature and moisture comfort zone, the core fiber elongates to decrease the first distance between the neighboring bimorph meta fibers in a respective yarn, thereby displacing the optical structures in the yarn closer each to the other which increases the electromagnetic coupling therebetween, which has the effect of adjusting the infrared emissivity of the composite fabric. The second distance between the neighboring yarns is increased, thus increasing the air convection through the openings between the yarns to promote moisture evaporation, air convection, and heat/moisture dissipation.

The hydrophilic material portion may be a fiber formed from diacetate, or cellulose, and the hydrophobic material portion may be a fiber formed from triacetate. Alternatively, the core fiber may be formed as a single fiber containing the hydrophilic and hydrophobic materials.

When the moisture and temperature applied to the bimorph composite fabric is lower than the predetermined temperature and moisture (comfort) zone, the core fiber shortens to increase the first distance between the neighboring bimorph meta fibers in a respective yarn, thereby decreasing electromagnetic coupling between the optical structures on the neighboring bimorph meta fibers which adjusts the infrared emissivity of the composite fabric and reduces the loss of moisture and heat. A decrease of the second distance between the yarns diminishes the heat and moisture release to keep a wearer of the fabric warm.

In a further aspect, the present invention is a method of manufacturing a composite material with self-regulated infrared emissivity, which comprises the steps of:

forming a base fiber by extruding a melted polymer from a spinneret, wherein the polymer may include triacetate, PET, nylons, cellulose, diacetate, and combinations thereof, drawing the base fiber through a bath containing CNTs solution, applying microwave radiation to the base fiber coated with the CNTs solution to bond the CNTs to the base fiber surface, thus forming a CNT-fiber composite, subsequently passing the CNT-fiber composite through a bath with PNP solution to form a PNP layer containing PNP beads on the surface of the CNT-fiber composite. A plurality of the meta fibers are subsequently arranged in a number of yarns, and the number of yarns are weaved in an array to form the composite material.

The size of the PNP beads is controlled by adjusting the concentration, viscosity and solvent components of the PNP solution, or by controlling a velocity of withdrawing of the fiber from the bath with the PNP solution.

These and other objects and advantages of the present system and method will be apparent from reading the following detailed description of the invention in conjunction with the patent drawing figures.

BRIEF DESCRIPTION OF THE DRAWINGS

FIG. 4A shows, on somewhat enlarged scale, PNP beads formed on the fiber, FIG. 4B is a side view of the PNP bead of the subject fiber, and FIG. 4C shows a cross section of the PNP bead at different temperature exposures;

FIG. 7A is a photograph of the commercial fabric "dyed" with CNT and PNP, FIG. 7B is a SEM image of the "dyed" fiber, and FIGS. 7C and 7D are SEM images of the "dyed" fiber showing uniform coating of the textile fibers with a thin layer of CNTs;

FIGS. 10A-10B show schematically the change of opening between fibers in the bimorph MCT fabric between dry and hydroscopic conditions, FIGS. 10C and 10D are representative of the optical shadow images showing the closed state (FIG. 10C) and open state (FIG. 10D), corresponding to FIGS. 10A and 10B, respectively, and FIGS. 10E and 10F are representative of the SEM images showing a decrease in spacing between the fibers from the closed state (FIG. 10E) to the open state (FIG. 10F);

FIG. 12A is representative of the subject MCT yarn model; FIG. 12B is a diagram representative of the emissivity of the structure with the core diameter of 1 μm and t=200 nm, and FIG. 12C is a diagram representative of the emissivity of the structure where the core diameter of 10 μm and t=200 nm;

FIG. 14A-14B are schematic diagrams showing a CNT-coated PNT yarn containing 27 fibers of approximately 10 μm in diameter transformed between unstretched (FIG. 14A) and stretched (FIG. 14B) configurations, and FIG. 14C show prominent stages of stretching of the yarn with 27 PNT fibers showing cross-section of the yarn reducing in size during the stretching of the yarn.

DETAILED DESCRIPTION OF THE PREFERRED EMBODIMENT

Figure 1A:
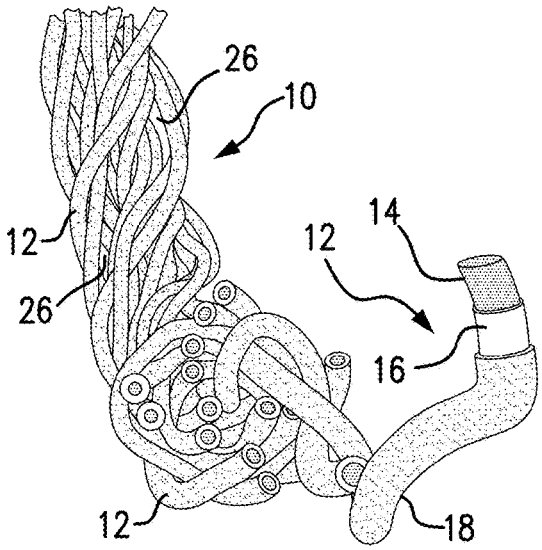
FIG. 1A shows, on somewhat enlarged scale, the subject meta-cooling fiber and the meta-cooling textile (MCT) yarn formed from the meta-cooling fibers.

The subject meta-cooling textile (MCT) is envisioned for a number of applications, where the infrared (IR) and/or moisture self-regulation are beneficial. For the sake of clarity, the present composite fabric will be further described as a fabric for clothing technologies in various areas. However, it should be clear that other numerous areas of usage are also envisioned for the subject composite materials.

The present composite fabric has an advanced quality of extending a wearer skin's thermal regulating capabilities to infrared (IR) emissivity control. The human body absorbs and loses heat primarily by infrared radiation peaking at around 10 μm (Owen, M. S., 2009 *Ashrae Handbook: Fundamentals*. American Society of Heating, Refrigerating and Air-Conditioning Engineers, Inc.: 2009). This mechanism is harnessed by the subject MCT clothing to afford temperature control well beyond skin's thermoregulation capabilities. MCT operates by modulating the infrared emissivity of the clothing in response to a thermal discomfort in an autonomous and self-powered fashion. Since infrared radiation heat transfer is a primary channel for energy exchange between a wearer's body and the environment, the ability to harness this mechanism is a breakthrough for wearable localized thermal management.

Furthermore, the subject MCT can synergistically integrate microstructure porosity and sweat absorption that further promotes air convection and the evaporative cooling.

The emissivity of the surface of a material may be defined as the effectiveness of the material in emitting energy as thermal radiation. Surface emissivity of textile fabrics are of high importance for comfort of wearers, as well as control of heat stress and heat load in shelters and undercoverings for military purposes, residential buildings, in offices, automobiles, airplanes, and ships interiors, etc.

According to Kirchhoff's law of thermal radiation, emissivity is equal to absorptivity of a material (for example, a textile). This permits tuning the emissivity of the textile by modifying its absorption. Among others, the important features of the subject MCT technology include:

(a) the optical property of the textile is based on the electromagnetic coupling of textile's fibers (as meta-elements). As a result, the resonant absorption of textile can be tuned to remain in the infrared regime that can match the person's thermal radiation. Due to its resonant nature, such absorption peak (thus emission) can be strong;

(b) the emission (absorption) peak position is determined by the electromagnetic coupling, which is mainly set in the subject structure by the spacing of fibers and is adaptable to environmental temperature/moisture change (due to the function of bimorph fibers).

These features offer a fundamental self-adapting mechanism to tune the IR emission of the subject textile without the cost of energy usage. Numerical modeling has been conducted (as described further herein) to describe the coupling between optical structures.

Figure 1C:
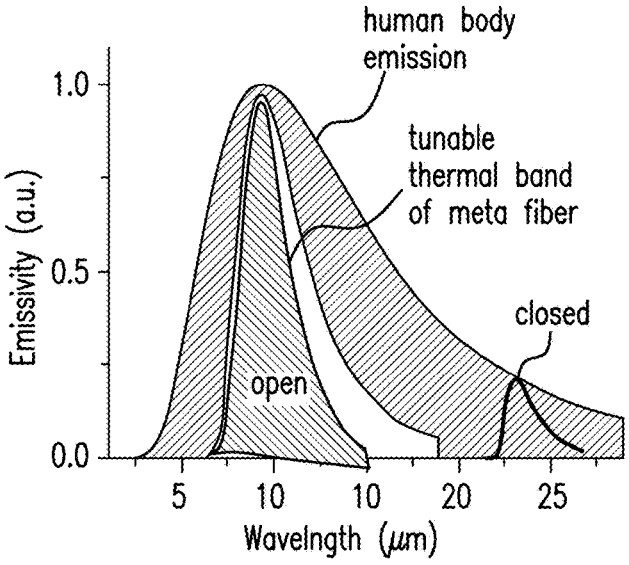
FIG. 1C is a diagram representative of fabric emissivity vs. wavelength of the subject MCT fabric.
Figure 1B:
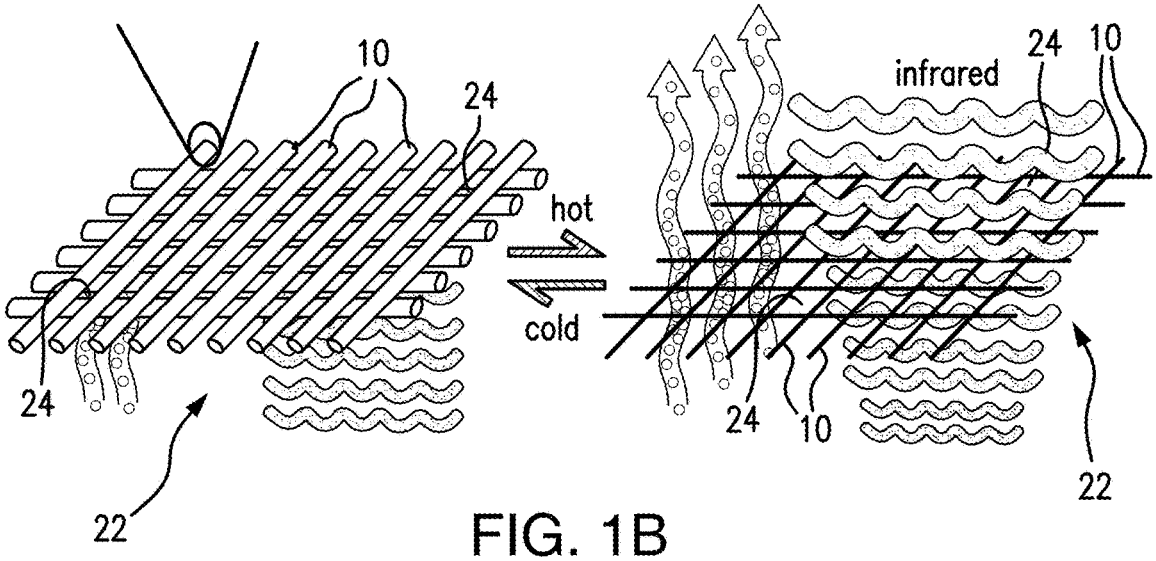
FIG. 1B is representative of working principles of the subject meta-cooling textile (MCT)

Referring to FIGS. 1A-1B, the subject meta-cooling textile (MCT) yarn 10 is formed with the meta-cooling fibers 12 (also referred to herein intermittently as MCT filaments) spun together to form the MCT yarn 10.

As shown in this embodiment, each MCT fiber 12 includes a base fiber 14 coated with a thin layer of meta elements 16, also referred to herein as meta coating.

Figure 1D:
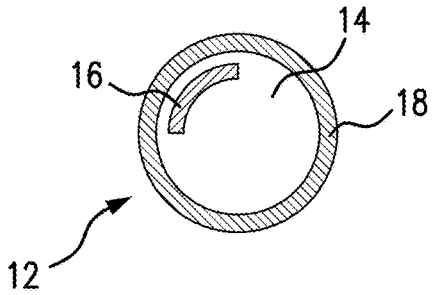
FIGS. 1D-1E show a cross-section of the subject meta-cooling fiber in alternative embodiments.
Figure 1E:
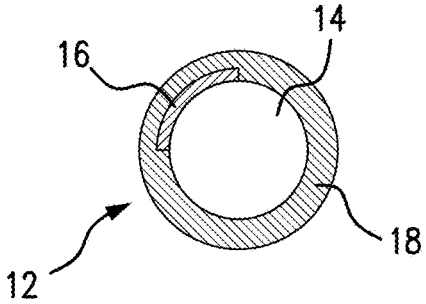

As shown in FIGS. 1D-1E, alternative to the co-axial positioning of the meta coating 16 on the base filament 14, the meta elements 16 may also be embedded in the base fiber 14 (FIG. 1D), or deposited as a thin layer on a portion of the base filament's surface (FIG. 1E).

The layer of meta elements 16 is further coated with a thermoresponsive polymer layer 18. In FIG. 1A, the thermoresponsive polymer layer 18 is shown as a uniform layer for simplicity, while a more detailed structure of the thermoresponsive polymer layer 18 showing polymer beads 20 can be seen in FIGS. 2-3, 4A-4C, 9A-9D, as well as FIG. 12A, and in other occurrences throughout this Specification.

An MCT fabric (or MCT textile) 22 shown in FIG. 1B, is woven from the MCT yarns 10 to form the fabric structure resembling an array of the MCT yarns 10 with multiple openings 24 (further referred to herein as textile openings) existing between the MCT yarns 10. As shown in FIG. 1A, the MCT yarn 10 itself has openings or spaces between the MCT fibers 12 forming the MCT yarn. These openings between the MCT fibers 12 in the MCT yarn 10 will be further referred to herein as yarn openings 26.

In the exemplary embodiment shown in FIG. 1A, each MCT fiber 12 may have a diameter of approximately 10 micrometers. Each MCT fiber 12 is coated with a thin layer (for example, of the thickness 10-20 nm) of nanostructures, such as, for example, carbon nanotubes (CNTs) thus forming the meta coating 16. Subsequently, on the top of the meta coating 16, the MCT fiber 12 is coated with a thermoresponsive polymer layer 18 which may include polymer beads 20 (for example, of 3 μm thickness made of 2-(2-methoxyethoxy)ethyl methacrylate oligo(ethylene glycol) methacrylate copolymer, or poly(N-isopropylacrylamide) (also referred to herein as PNP), as well as combinations thereof.

The temperature responsive polymer layer may have a thickness ranging from 0.1 μm and 50 μm, and may fall in several ranges, including 2 μm-10 μm, 1 μm-15 μm, or 0.1 μm-30 μm.

The optical CNT structure may, for example, have a weight in several ranges, including 0.025-1.5%, 0.05-0.5%, and 0.1-0.25% of the weight of the composite fabric.

As shown in FIG. 1B, when temperature T applied to the fabric 22 (either produced by the body, or applied from environment, or both) exceeds a comfort temperature $T_c$, i.e., $T>T_c$, the polymer 18 shrinks, thus inducing two synergetic cooling effects, as well as their combinations. For example, during the exposure to the elevated temperature ($T>T_c$), the nanostructure layers 16 may come 5-10 μm closer each to the other within the MCT yarns 10, thus inducing the resonant electromagnetic coupling therebetween that shifts the infrared peak emissivity to maximally match that of the body surface, as shown in FIG. 1C.

Figure 2:
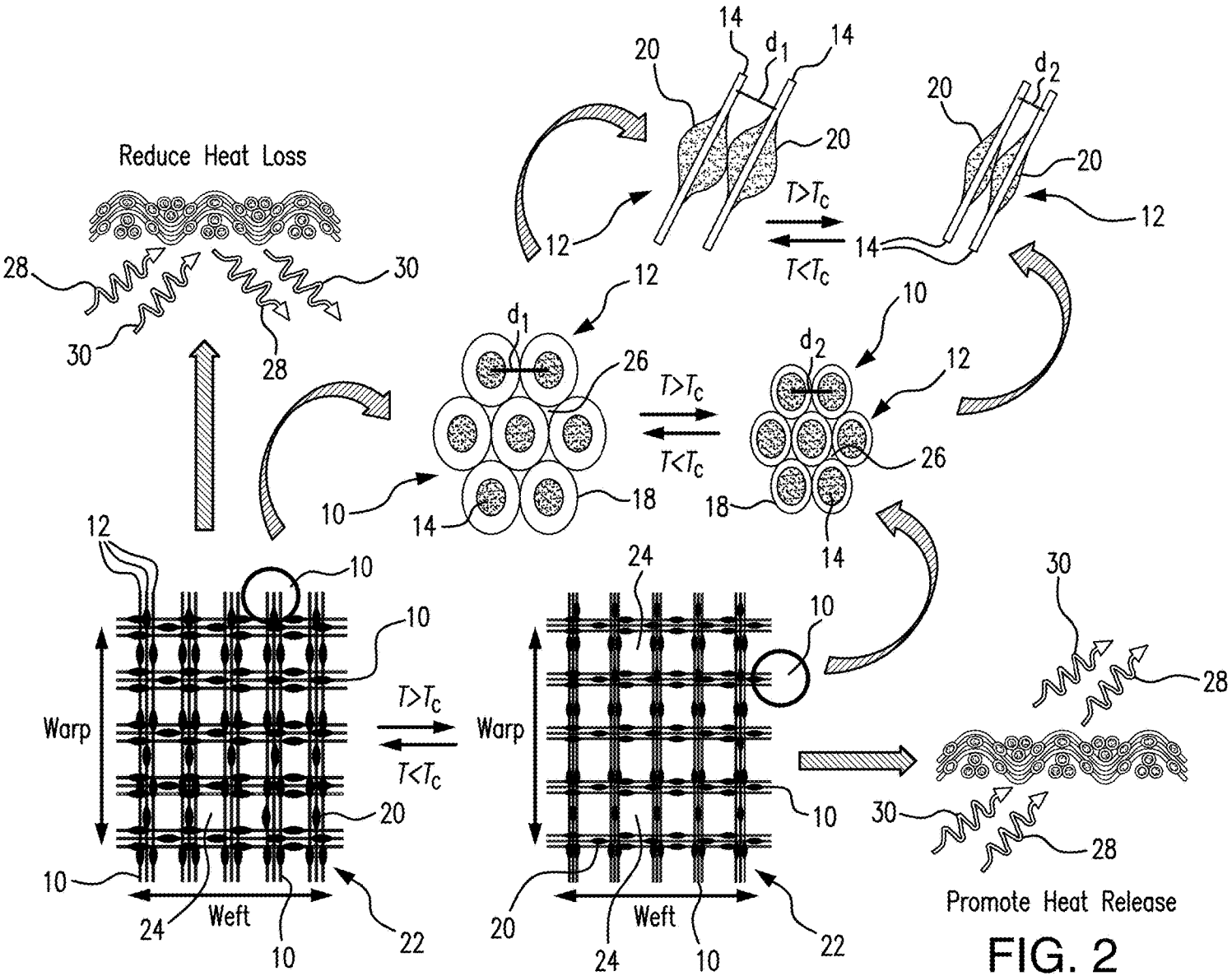
FIG. 2 is a schematic diagram of the design of the subject MCT fabric with tunable thermal properties illustrating mechanism for reducing heat loss and promoting heat release at different temperature conditions.

Synergistically, as shown in FIGS. 1B and 2, the shrinkage of the polymer layer 18 (when $T>T_c$), causes reduction of the yarn openings 26 and an increase of the physical openings (textile openings) 24 in the fabrics 22, and also reduces the fabric thickness. This lowers the resistance of the MCT fabric (textile) 22 to air convective, conductive, and moisture heat transfer.

Reversibly, when the MCT fabric 22 is exposed to a lower temperature ($T<T_c$), the opposite effects occur to maintain body warmth and in the temperature comfort zone.

The purpose of the meta coatings 16 with meta elements is to modify the fibers 12 and achieve meta-material properties in order to control the electromagnetic properties of the MCT fabric 22 depending on the response of the polymer layer 18 to the climate changes, i.e., the temperature.

The detailed exemplary design incorporating CNTs as meta elements and Poly(N-isopropylacrylamide) as the thermally responsive polymer 18 is shown in FIG. 2, where the MCT fabric 22 is formed with the MCT yarns 10 arranged in an array. Each yarn 10 is formed with the MCT fibers 12 represented by the base fiber 14 covered with the meta coating 16 and the thermoresponsive polymer layer 18 built with the polymer beads 20.

Depending on the temperature applied to the MCT fabric 22, the polymer layer 18 undergoes shrinkage or expansion, and thus adjusts the distance d between neighboring MCT fibers 12 in the MCT yarn 10 to induce (or diminish) the electromagnetic coupling.

When exposed to a temperature T below $T_c$ ($T<T_c$), the yarn openings 26 between the MCT fibers 12 in the MCT yarn 10 are large, and the textile openings 24 between the MCT yarns 10 within the MCT fabric 22 are small. As seen in the cross-section of the yarns exposed to the lower temperature, the distance $d_1$ between the center of the MCT fibers 12 is larger than the distance $d_2$ between the centers of the MCT fibers 12 when exposed to an elevated temperature.

Accordingly, when exposed to a lower temperature ($T<T_c$), the structure switches to the reduced heat loss regime supported by the mechanism of expansion of the thermoresponsive polymer layer 18.

In the reduced heat loss regime, the heat produced by the skin of the MCT fabric wearer does not escape through the textile openings 24 and returns to the skin of the textile wearer, as presented in FIG. 2, where the flow is shown as curved arrows 28 which are representative of the IR radiation and the curved arrows 30 are representative of the moisture in operation.

If, however, the MCT fabric 22 is exposed to an elevated temperature ($T>T_c$), the thermoresponsive polymer layer 18 (polymer beads 20) shrinks, thus reducing the distance between the centers of the MCT fibers 12 ($d_2<d_1$). The yarn openings 26 between the meta fibers 12 within the MCT yarn 10 are reduced in size, while the textile openings 24 between the yarns 10 in the MCT fabric 22 are increased.

In this regime, the air convection through the textile 22 is increased due to the enlarged textile openings 24, and the infrared emissivity is increased due to the resonant electromagnetic coupling between neighboring meta elements 16 on the neighboring meta-cooling fibers 12. The MCT fabric 22 thus switches to a heat release regime where the heat produced by the skin of the MCT fabric wearer is released through the openings 24 in the MCT fabric 22.

Figure 3:
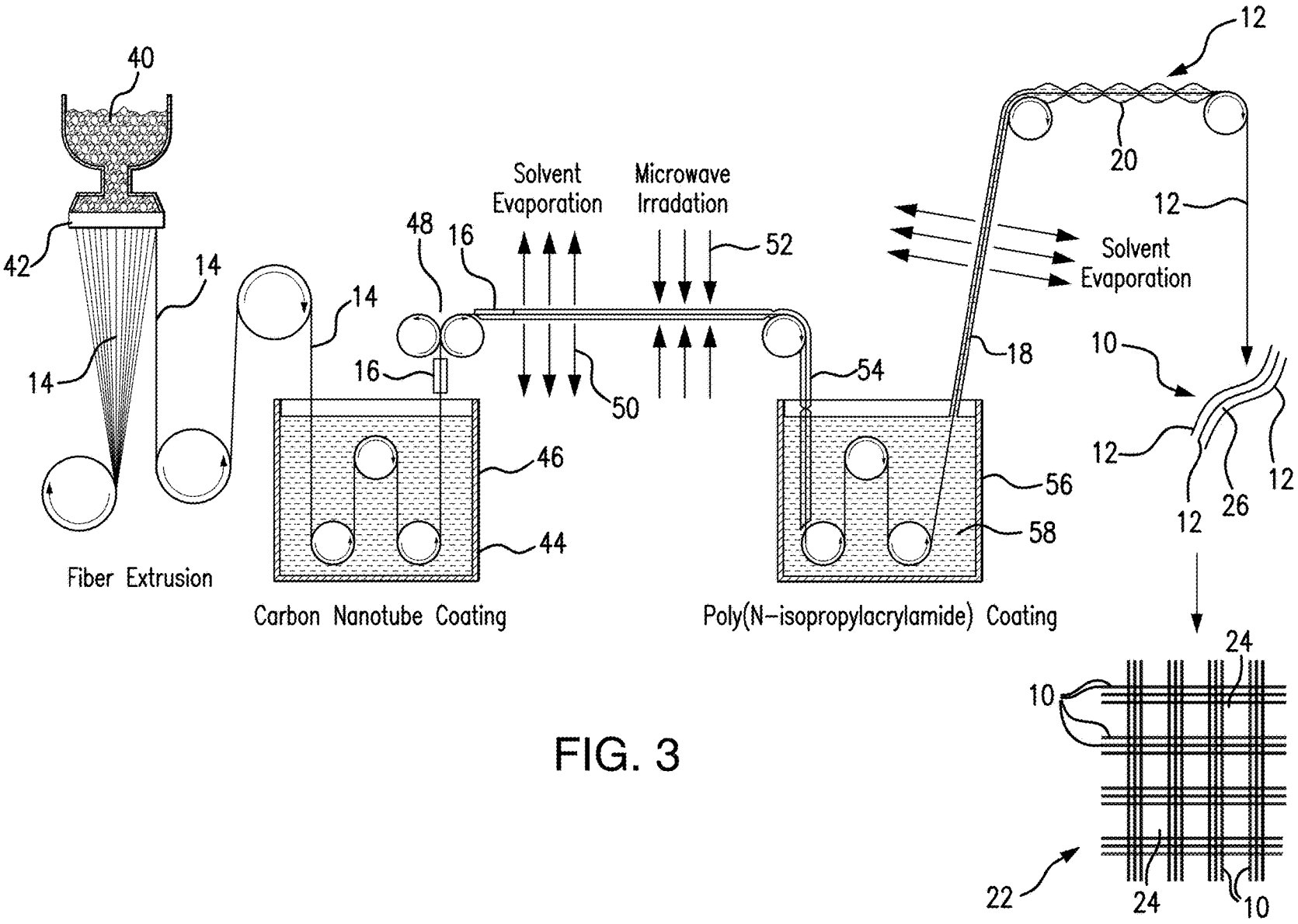
FIG. 3 is a schematic flow diagram of the manufacturing process for production of the subject meta-cooling fibers.

FIG. 3 is illustrative of the manufacturing process for the meta-cooling fiber 12 based on the solution "dyeing" technique. A melted basic fiber-forming polymer 40 is extruded from a spinneret 42 and forms into an individual base monofilament/fiber 14. The base monofilament/fiber 14 is subsequently drawn through a bath 44 containing CNT solution 46. At the exit of the bath 44, the excess CNT solution is squeezed out with pressure rolls 48 or by padding.

Subsequently, a solvent evaporation step 50 is performed, and the monofilament/fiber covered with the CNT solution 16 is treated by microwave irradiation 52 to bond the CNT coating 16 firmly to the base fiber 14 to form the CNT-fiber composite 54.

Subsequently, the CNT-fiber composite 54 is passed through a bath 56 of PNP solution 58. A thin film 18 of the PNP solution is adsorbed on the fiber surface, and eventually the film separates into beads 20 on the fiber to produce the meta fiber 12. The meta-fibers 12 are subsequently formed into the yarns 10 (which have yarn openings 26 therebetween). The yarns 10 further are fabricated into a fabric 22 with openings 24 between the yarns 10.

Figures 4A, 4B, 4C:
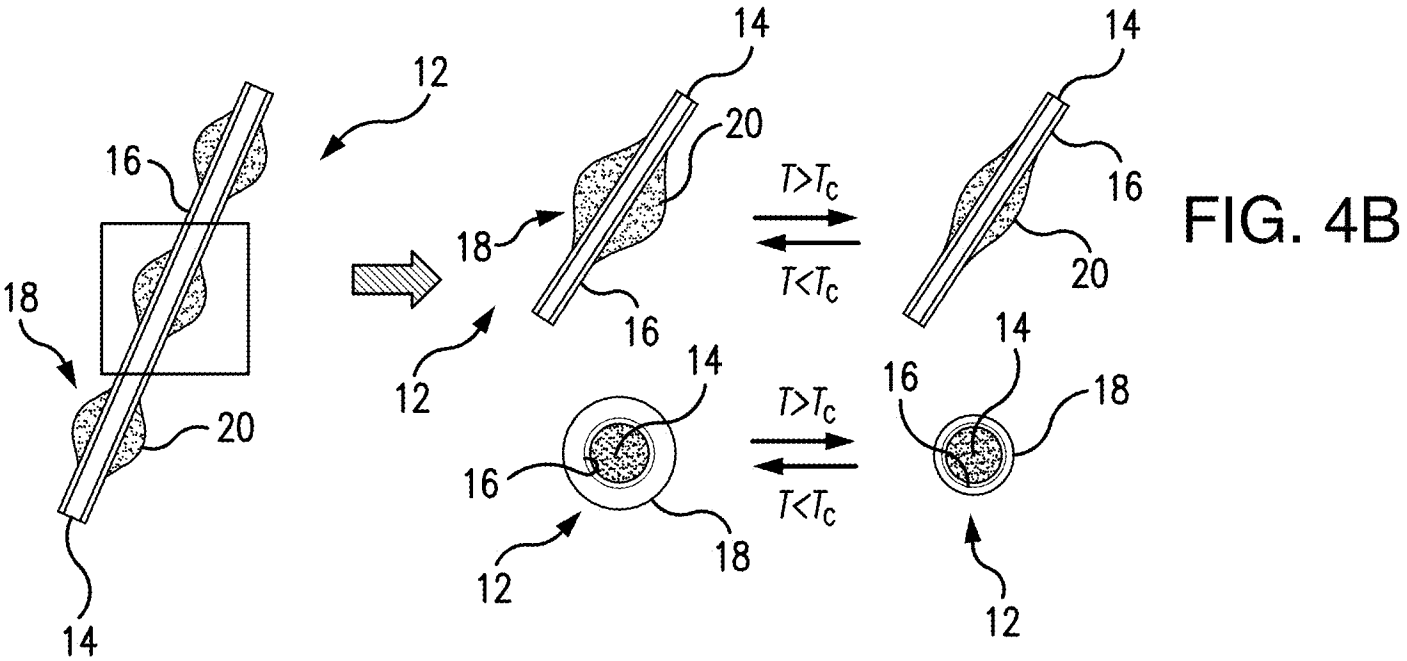
FIG. 4A-4C are schematic diagrams of the thermal response mechanism in the subject meta-cooling fiber, where

FIGS. 4A-4C illustrate the thermal response mechanism of the meta fiber 12 having the base fiber 14 covered by the polymer beads 20 of the thermo-responsive polymer layer 18 (on the meta layer 16). The PNP bead 20 on the fiber 14 (as shown in FIG. 4A), shrinks at a temperature T which is higher than the lower critical solution temperature (LCST) of PNP, i.e., Tc=~32.4° C., and expands at a temperature T which is lower than LCST. FIGS. 4B-4C illustrate the side view and cross-section view, respectively, of the meta fiber covered with the PNP beads 20. The base fiber 14 itself does not change size, but the polymer beads 20 change sizes when exposed to the temperature changes.

As the MCT fiber 12 is manufactured into the fiber bundle/yarn 10 as shown in FIG. 3, at a temperature T higher than LCST of PNP ($T>T_c$), the shrinkage of the PNP beads 20 decreases the distance between fibers 12 and induces the resonant electromagnetic (EM) coupling between the peak emissivity and the human body radiation, as shown in FIG. 1C. As the fiber bundle/yarn 10 is woven into the MCT fabric 22, the EM coupling effect within the yarn 10 promotes the thermal release of the human body IR radiation.

Meanwhile, the enlargement of the openings 24 between the adjacent yarns 10 leads to a large open area in the MCT fabric 22 and the fabric's thickness decreases, thus promoting thermal convection, thermal conduction and moisture transfer to support the heat release regime, wherein excessive heat dissipates from the human skin to the ambient to aid the wearer's comfort.

On the contrary, at a temperature T lower than LCST ($T<T_c$), expansion of the thermal-responsive polymer beads 20 positions the fibers in a more spaced-apart manner in the same yarn (i.e., the yarn spaces 26 become larger), and brings neighboring yarns 10 closer each to the other (textile openings 24 become smaller) leading to:

(a) absence of the EM coupling effect with the human body IR radiation, (b) decrease of the opening area 24 in the MCT fabric 22, and (c) increase of the MCT fabric 22 thickness. Thus more heat is maintained between the MCT textile 22 and the 22 human body to reduce heat loss.

As shown in FIGS. 1-2, and 4A-4C, the subject MCT textile 22 is capable of a bidirectional reversible IR emissivity regulation.

Among the ample class of thermoresponsive polymers, PNP is a stand-out polymer material since it is capable of undergoing a reversible and sharp change in its molecular structure from a coil to a compact globular state at a predetermined temperature $T_c$, which is the Lower Critical Solution Temperature (LCST) for the polymer. For the PNP solution the LCST is approximately 32.4° C. in the presence of moisture.

When $T>T_c$, the polymer molecular chains collapse, and oppositely, when $T<T_c$, the polymer molecular chains expand. Switching between the two states in the PNP molecules induces a size change by nearly an order of magnitude.

Due to the fact that this coil-globule transition occurs in vicinity of the comfortable skin temperature (32° C.-33° C.) and can be conveniently tuned through polymer engineering, PNP is envisioned for use as the thermoresponsive "switch" for the subject MCT technology.

Although PNP is water soluble at the room temperature, the polymer can be cross-linked using low cost free radical polymerization process to form microparticles that prevent their dissolution in water (as presented in Otake, K, et al., "Macromolecules", 1990, 23, (1), 283-289). The microparticles can be synthesized with remarkably uniform size that can be easily controlled on a micrometer scale.

The cross-linked particles have a three-dimensional network structure that swells and shrinks rapidly (in seconds) in response to temperature change, as presented in Pelton, R., *Advances in Colloid and Interface Science* 2000, 85, (1), 1-33. This temperature-sensitive property is reversible and reproducible with the water-soluble polymer counterparts.

As an example, PNP may be chosen as the material for the thermo-responsive polymer layer 18 based on the following considerations:

(a) it is effectively thermoresponsive;

(b) it has been comprehensively investigated for both production and application, and can be easily manufactured by radical polymerization at low cost and with a narrow polydispersity of the molecular weight;

(c) PNP has already been applied to and proved to be useful in many different areas including medical applications; and (d) has the transition temperature in the vicinity of 32° C., which substantially coincides with normal skin temperature. The $T_c$ of PNP can be systematically tuned by copolymerization with different monomers.

In addition to PNP, there are numerous thermoresponsive polymers that can be applied to textiles, as evident from Tao, X., *Smart Fibres, Fabrics and Clothing*, Woodhead Publishing: Cambridge, 2001; and, Crespy, D.; Rossi, R. M., *Polymer International* 2007, 56, (12), 1461-1468.

Figure 5:
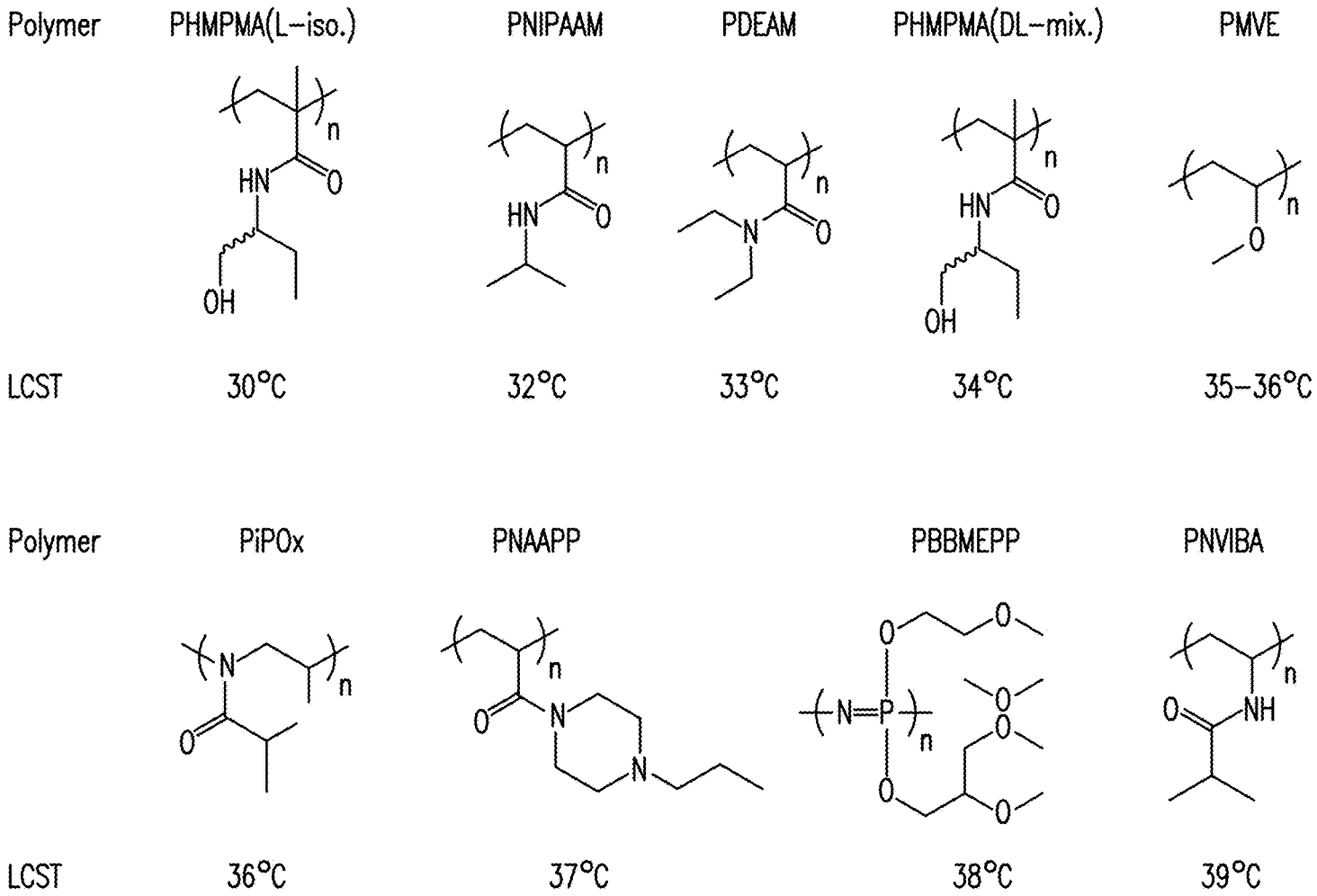
FIG. 5 is representative of a variety of thermal responsive polymers with different LCST which are envisioned as candidates for being grafted onto the subject meta-cooling fibers and utilized selectively depending on a specific need.

FIG. 5 presents thermoresponsive polymers with different $T_c$ that are envisioned to be grafted onto fabrics 22 and selectively utilized depending on specific needs. The temperature tuneability of the polymers with different $T_c$ allows tailoring the MCT fabric 22 to match personal thermal comfort and climate conditions.

An example of an alternative design envisioned for the subject MCT fibers and fabrics, integrates commercially available (or custom designed) moisture responsive fibers in the MCT structure to achieve the thermoresponsive properties. Examples of moisture responsive fibers may include (but not limited to) Teijin's M.R.T. (Moisture Responded Transformable) fiber, which is used in Nike's Sphere React fabrics. The M.R.T. fiber is envisioned to be used in conjunction with the subject meta technology to manufacture sweat-and-heat-responsive textiles that can change macro shape or micro structure of the fabrics to improve moisture and heat managements.

As will be detailed further herein, the operation of the subject bimorph composite fabric is based on the ability of the fabric to form vents (openings) of about 10 mm in diameter which automatically close when the fabric is exposed to dry (and cold) environment and open to release heat and sweat when hot and moist.

The M.R.T. technology uses a polyester fiber that can rapidly absorb and discharge moisture. The M.R.T. fiber stretches when exposed to moisture and shrinks when dry.

Figure 6:
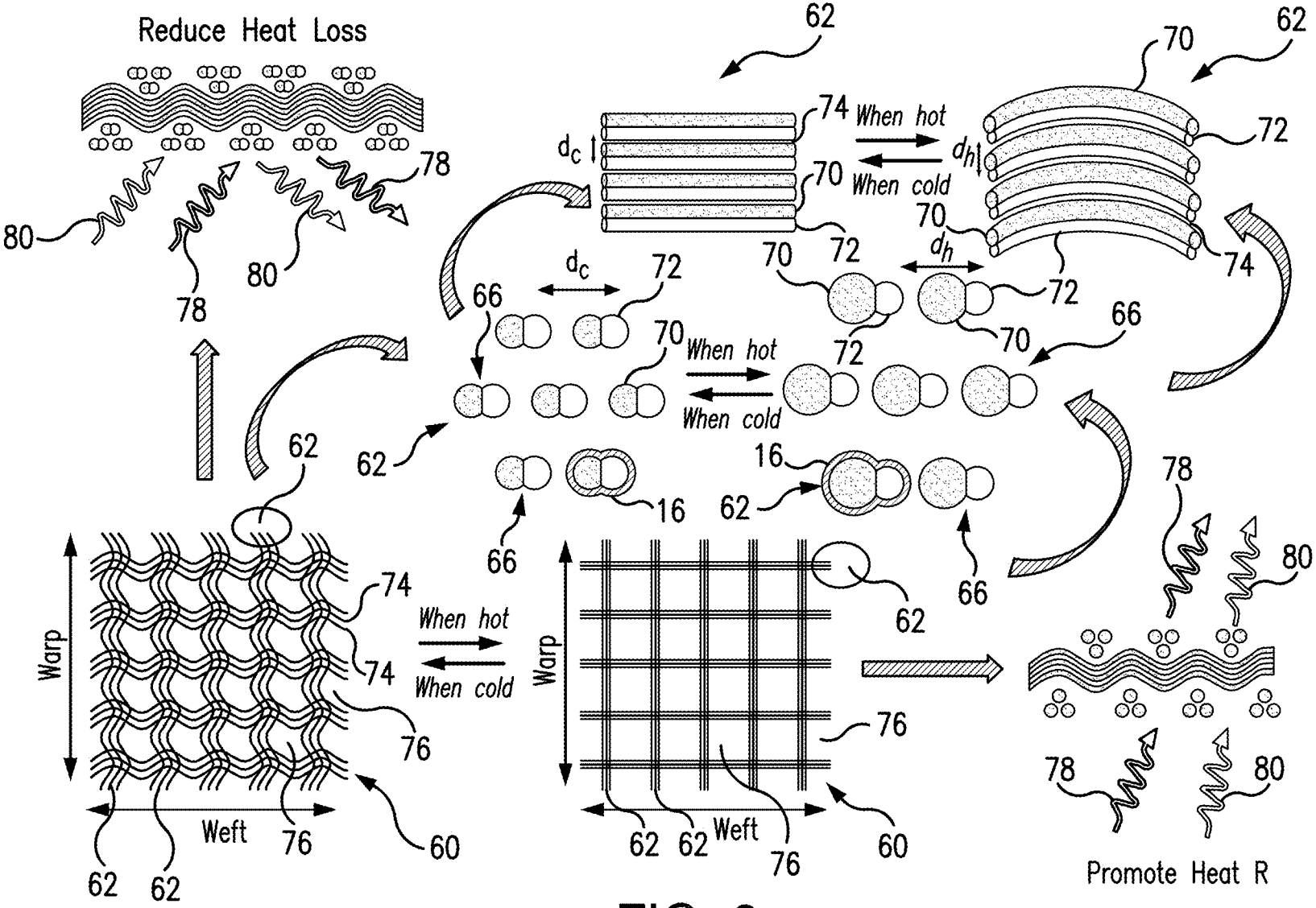
FIG. 6 is illustrative of a design of the subject MCT fabric based on bimorph fibers providing tunable thermal and moisture properties and illustrative of the operative principles of the bimorph MCT fabric for reduced heat loss or promote heat release depending on different temperature and moisture exposure.

An example of the bimorph MCT technology is illustrated in FIG. 6, where the MCT fabric 60 is formed from a number of the bimorph MCT yarns 62 disposed in an array-like fashion. Each of the yarns 62 is formed from the bimorph MCT fibers 66. Each bimorph MCT fiber 66 is formed as a composite fiber manufactured, for example, from polyester cellulose/triacetate coated with the optical nanostructure coating (also referred to herein as CNT coating structures) 16.

In one implementation, the composite fiber 66 may be formed with a fiber 70 made of a hydrophilic material and with a fiber 72 thrilled from a hydrophobic material.

Thermoresponsive behavior has been observed from the prototypical bimorph MCT fabrics 60 made of CNT-coated composite fibers 66 which are manufactured from polyester cellulose/triacetate. The cellulose fiber 70 is hydrophilic, while the triacetate fiber 72 is hydrophobic. Being a bimorph, the two acetate materials (cellulose and triacetate) respond differently (asymmetrically) to moisture exposure, causing one of the materials to expand more than the other, thus transitioning the composite fiber 66 between "open" and "closed" configurations, which changes the distance between neighboring fibers 66 in each yarn 62 (thus modulating the IR emissivity of the fabric defined by the mutual interposition of the CNT coating structures 16), and correspondingly enlarging (opening) or reducing (closing) the openings 76 between yarns 62 in the fabric 60 (thus controlling the heat release mechanism).

When wet (and hot), the fiber 66 extends to create gaps (openings) 76 that promote moisture evaporation and air convection. When dry (and cold), the fibers 66 curl to increase insulation, and to move fibers 66 apart to achieve corresponding IR response.

Bimorph fibers 66 can be produced at the manufacturing facility (shown in FIG. 3 by extruding (instead of one) two different polymers from one spinneret, to form a base fiber which contains two polymers (one with the hydrophobic properties, and another with hydrophilic properties, or can be chemically converted to become hydrophilic). In this implementation, the composite fiber 66 can be made of cellulose and triacetate (e.g., 50/50 wt %). This fiber can respond effectively to moisture/humidity due to different moisture absorption behavior (cellulose is hydrophilic and triacetate is hydrophobic).

As shown in FIG. 6, the cellulose portion (70) swells both in longitudinal and axial directions after absorbing moisture, while the triacetate components (72) has negligible changes due to its hydrophobicity. This bimorph response leads to a tunable change in spacing 74 between fibers 66.

The moisture/humidity response caused by asymmetrical internal stress is maintained after coating the surface of the fiber 66 with meta elements, for example, the CNT coating structure 16, thus forming the bimorph MCT fiber 66.

Fiber 66 elongates when it moistens due to perspiration as shown in FIG. 6. The elongation of the fiber 66 causes a decrease of inter-fiber distance (yarn openings 74) locally within the bimorph MCT yarn 62, leading to change in resonant electromagnetic coupling (and hence increased infrared radiation) to maintain thermal and moisture comfort. Synergistically, the spacing among bimorph MCT yarns 62 (textile openings 76) increases to enhance heat release from the bimorph MCT fabric 60 by promoting the heat release regime with increased IR radiation, convection, conduction, and moisture evaporation, thus also improving the breathability of the fabric.

When however the temperature is below the critical temperature $T_c$, with the dry condition (no excessive perspiration), the fibers 66 shrink, thus causing an increase of spacing between the fibers 66 within the bimorph MCT yarn 62, so that the yarn openings 74 within the bimorph MCT yarn 62 are increased.

The change of the spacing between composite yarns 66 within the bimorph MCT yarn 62 leads to reduction in electromagnetic coupling between optical nanostructures 68. Synergistically, the spacing 76 among yarns 62 in the MCT fabric 60 decreases to promote the reduced heat loss regime. In FIG. 6, the curved arrows 78 are representative of the IR radiation, while the curved arrows 80 are representative of the moisture evaporation.

The change of the structure of the bimorph fibers 66 when exposed to different environmental conditions, i.e., the elevated temperature vs. reduced temperature and/or elevated perspiration vs. dry conditions, is reversible, supporting the bidirectional thermos and moisture self-regulation in the present bimorph MCT fabric 60.

Experimental Results

Figure 7A:
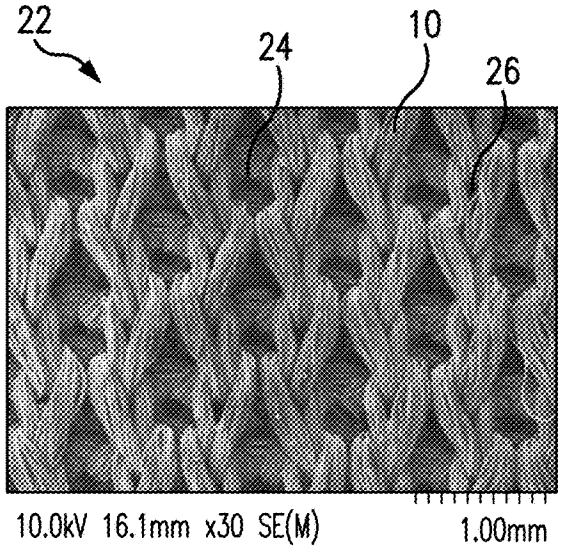
FIGS. 7A-7D are photo micrographs of the prototype MCT fibers fabricated by coating commercially available cotton-polyester composite yarns with a thin layer of CNT and PNP, where
Figure 7B:
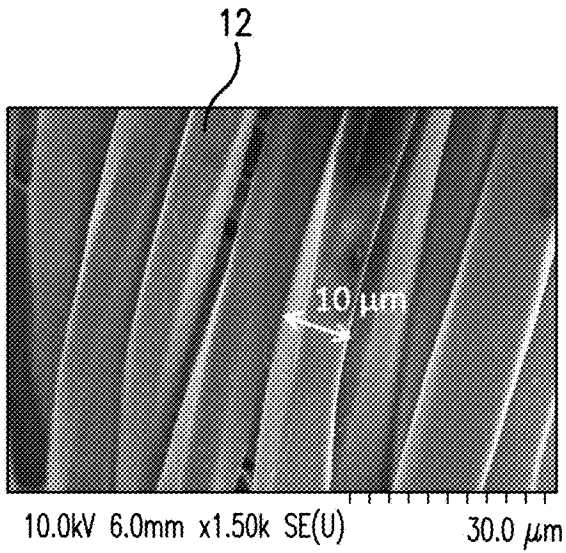
Figure 7C:
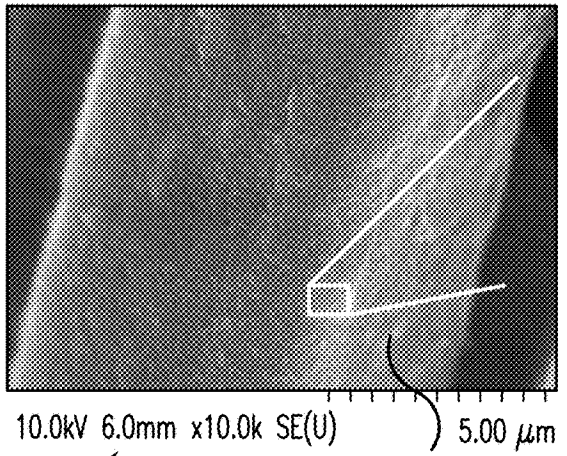
Figure 7D:
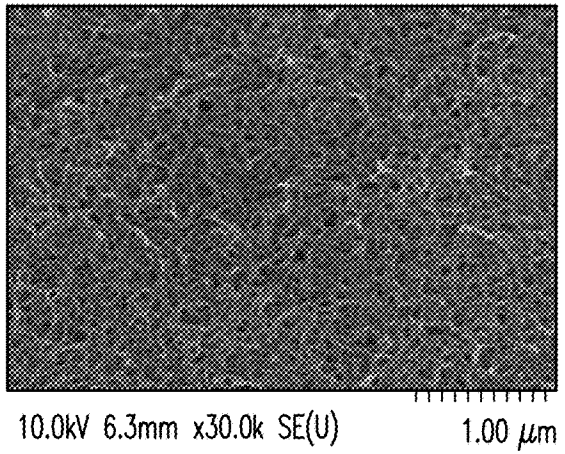

Prototype MCT fibers have been fabricated by coating commercially available cotton-polyester composite yarns with a thin layer of CNTs and PNP. FIG. 7A illustrates the composite fabric 22 formed with the MCT yarns 10. Shown are yarn openings 26 and fabric openings 24 between the yarns 10. As shown in FIGS. 7B-7D, the CNTs 16 are coated on the textile fibers 12 as uniform thin layers with strong adhesion that can survive repetitive washing.

In one of the implementations, polyester was selected as the base fiber 14 due to its thermal plasticity, low cost and extensive use in textile applications, and CNTs 16 were selected as meta elements due to their chemical stability, mechanical flexibility, and textile fiber-matched length scales. In order to coat the CNTs onto the polyester base fiber 14, a strong bonding is needed for textile applications (e.g., the MCT fabric 22 is expected to be re-wearable and repeatedly washable).

As an example, a method of the microwave irradiation can be used to form the strong bonding force between the base fiber and the meta coating due to the fact that the microwave processing is non-contact, pollution free and has a rapid distribution of thermal energy.

Microwave irradiation directly couples the electromagnetic energy with a material through molecular interactions, and the generated energy is dissipated by heat release. Thus, the electromagnetic field of a microwave radiation and the dielectric response (e.g., dielectric loss factor) of a material governs the heating process with microwave energy.

The electric field in microwave radiation decreases from the surface of a material to the material's inner volume. A parameter, known as the penetration depth, is used to describe the decay of the electric filed within the material. The penetration depth is defined as the distance between the sample surface and an inner face where the absorbed power is 1/e of the absorbed power from its surface. For materials with large dielectric loss factors (such as metal and metallic CNTs), the penetration depth approaches zero, and these materials are defined as reflectors. For materials with low dielectric loss factors, such as polymers (including polyester), the penetration depth is very large, leading to the fact that a very small amount of energy can be absorbed by the material. These materials are considered as transparent to microwave energy. Thus, microwaves transfer energy is most effective for the materials with a medium dielectric loss factor.

In the experiments performed, a solution of metallic, multi-walled CNTs was produced by dispersing (SWeNT®, SMW 100) into 2 wt % sodium dodecyl sulfate (SDS) aqueous solution. Different concentrations of CNT ink were prepared. The CNT solution was bath-sonicated for 20 min. A polyester base fiber was coated in the CNT solution, as shown in FIG. 3, and dried in the oven at 80° C. for 1 hour. Subsequently, the fiber was exposed to microwave radiation (GE, JES1142SJ06 Turntable Microwave Oven, 1100 watts, 2.5 GHz) for 5 sec.

As a result, CNTs were bonded with the base polyester fiber, to form a CNT-polyester composite after exposure to the microwave radiation. In this process, a large amount of heat applied to the CNTs (metallic material acting as a reflector) for just a few seconds due to generation of high concentrations of electric charges or electric current, rendered the CNT to act as a heating element.

Subsequently, the heat transferred from the CNTs to its surrounding polyester matrix (transparent to the microwave radiation) caused the abrupt increase of the local temperature on the polyester base fiber. As it reached the melting point (~260° C.), the adjacent polyester melted and wetted the fiber.

After cooling down to room temperature, the CNTs and the surrounding polyester base fiber were observed to be firmly intercalated. This phenomenon is defined as "microwave welding" process.

It was also observed that the polyester base fiber melted locally without affecting the morphology of other parts of the fiber which were not in a direct contact with the CNT structure due to the limited thermal conduction (polyester having no contact with the CNT structure could serve as a cooling reservoir), low thermal conductivity (0.15-0.4 W $m^{-1}$ $K^{-1}$ for polyester and 40-3000 W $m^{-1}$ $K^{-1}$ for CNT), and the transparent properties of polyester (low dielectric loss factor) exposed to the microwave radiation. Thus the overall structure of polyester was maintained.

To further demonstrate the welding between CNTs fiber and polyester base fiber, the CNT-polyester composite was sonicated in 2 wt % SDS aqueous solution for 10 min to detach the unbounded CNTs. Experimental results showed that the CNTs still remained on the polyester fiber after sonication, which implied a strong intercalation.

Figure 8A:
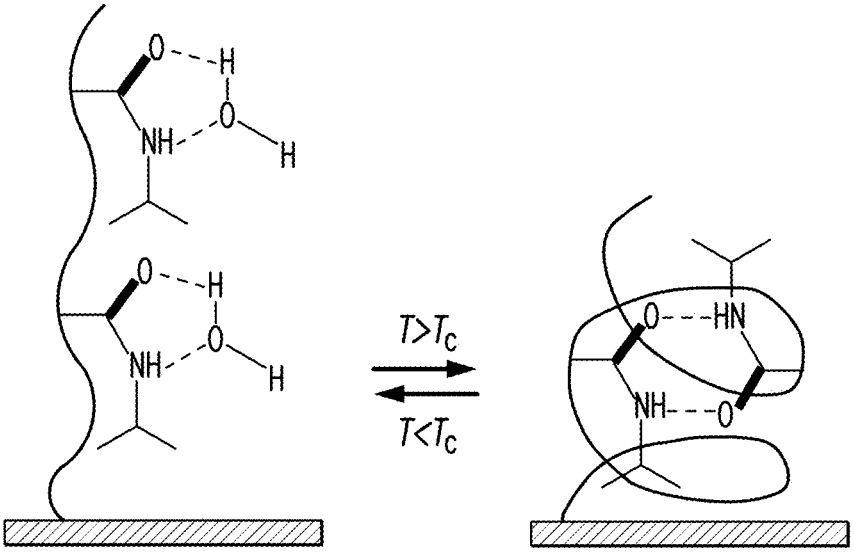
FIG. 8A is a schematic flow diagram showing the transition of the PNP molecule between the inter-molecular (coil seal IL) and intra-molecular (globule) hydrogen binding depending on the temperature.

In experiments, the PNP was initially selected as the thermoresponsive polymer to coat the fibers. PNP shrinks when exposed to elevated temperatures ($T>T_c$=~32° C.), and expands when exposed to low temperatures ($T<T_c$). The volume change of PNP is due to the inter-molecular (expanded coil state) to intra-molecular (collapsed globule state) hydrogen binding transitions, as shown in FIG. 8A.

PNP can either form the hydrogen binding with water molecules (absorbing water at $T<T_c$) or with itself (releasing water at $T<T_c$), manifesting a volume change at micro-/macroscale.

During the transition, different functional groups of the PNP material expose to the surface, and the wettability changes reversibly and responsively at the liquid-solid (or water-polymer) interface, acting as a hydrophilic (below the transition temperature Tc), and as a hydrophobic (above the transition temperature).

Figure 8B:
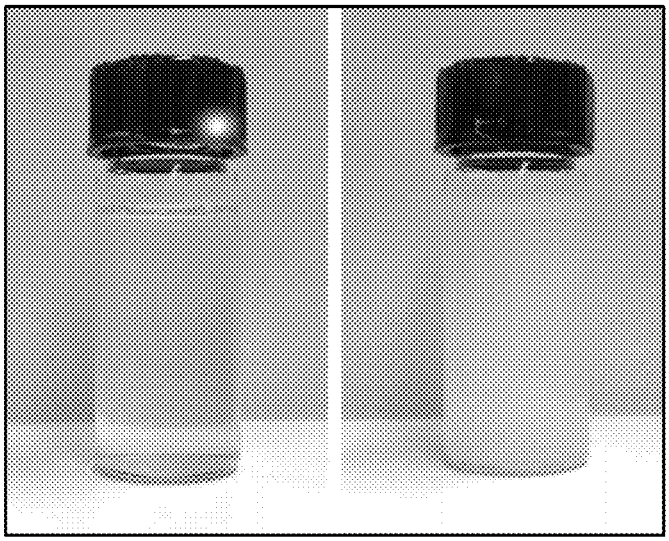
FIG. 8B is a photo image showing the change of the PNP in aqueous solution from being transparent ($T<T_c$) and opaque ($T>T_c$)
Figure 9A:
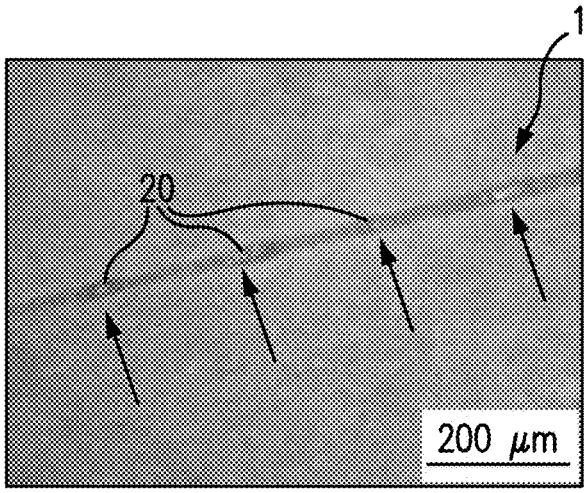
FIGS. 9A-9D are photographs of the PNP beads coated on the polyester fiber (FIG. 9A), and the PNP beads varying in size (FIGS. 9B-9D) by controlling withdrawing the velocity of the fiber during coating process.
Figure 9B:
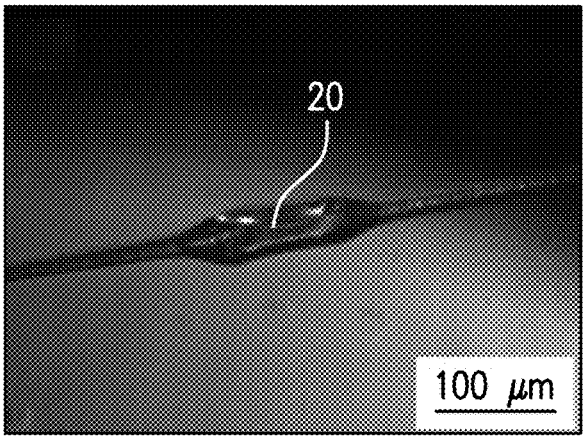
Figure 9C:
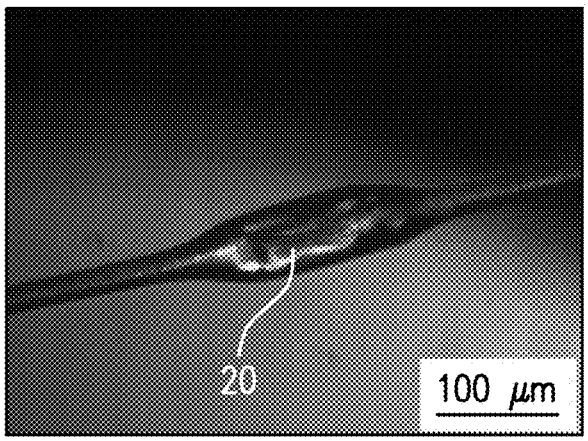
Figure 9D:
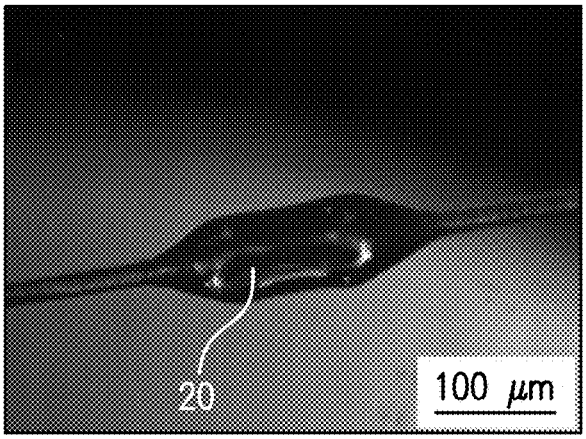

In aqueous solutions, PNP is transparent at $T<T_c$ and opaque at $T>T_c$, as shown in FIG. 8B. Because of these properties, PNP is envisioned as one of the candidates for coating fibers in clothing/technologies.

In experiments, 300 mg of PNP (Cat #963, Scientific Polymer Products, Inc.) was dissolved in 5 mL distilled water to form a coating solution. The base polyester fiber was drawn through a PNP aqueous solution in a "U" shape container and withdrawn at a velocity of 1, 2 or 3 cm/s.

Initially, a thin layer of the PNP solution was drawn out and uniformly adsorbed at the fiber surface. Subsequently, the thin layer of the PNP solution separated into individual beads under effects of perturbation and surface tension.

The shape of PNP beads is highly related to the Bond number of the PNP solution. Bond numbers are defined as $$B_o = pgL^2/\gamma_{LV}, \quad \text{Eq. (1)}$$

where $B_o$ refers to the Bond number, p refers to the density of liquids, g refers to the gravitational acceleration, L refers to the characteristic length, and $\gamma_{LV}$ refers to the liquid-vapor interfacial energy.

A high Bond number (close to or larger than 1) indicates that the gravitational force is dominant and the bead either falls off or forms an asymmetric "clam" shape on the fiber. A low Bond number (much smaller than 1) indicates that the surface tension force is dominant, and the bead forms a symmetric bell shape on the fiber. In the experimental example, the surface tension was dominant (Bond number ~0.04), and the PNP beads remained at the fiber surface in the shape of a bell. Subsequently, the bell shaped bead dried in air.

FIGS. 9A-9D show PNP beads 20 with a diameter of 6, 9 and 15 μm which were coated on the polyester base fibers 12 of approximately 10 μm in diameter. In the MCT fibers, the thickness t of PNP bead is one of the most important factors dominating the distance between the MCT fibers in the MCT yarns, and thus affects the infrared emissivity control in clothing.

According to the finite element modeling (FEM), a range of 0 to 8 μm in diameter for the PNP beads (in their globular state) was appropriate for the MCT design, and t=3 μm was optimum for the fiber with a diameter of 10 μm. By analogy, the bead size should be 5-6 μm in diameter when it is in the coil state, which is close to the beads sizes shown in FIGS. 9A-9D.

The bead size can be controlled by adjusting the concentration of the PNP in solution (or viscosity), or controlling the withdrawing velocity of the fiber during the coating, as well as by adjusting the solvent components (e.g., water, methanol, or a mixture of the water and methanol).

Figure 10A:
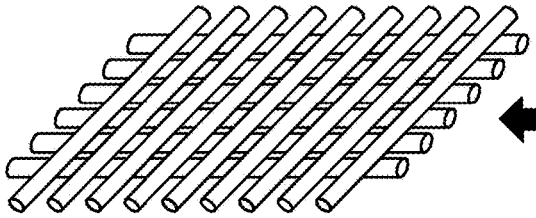
FIG. 10A-10F are photo micrographs of the bimorph MCT fabric, where
Figure 10B:
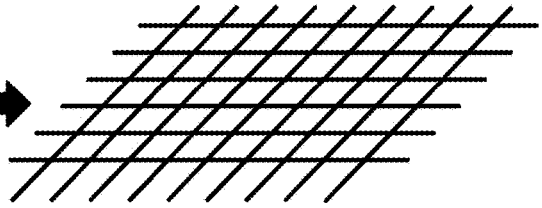
Figure 10C:
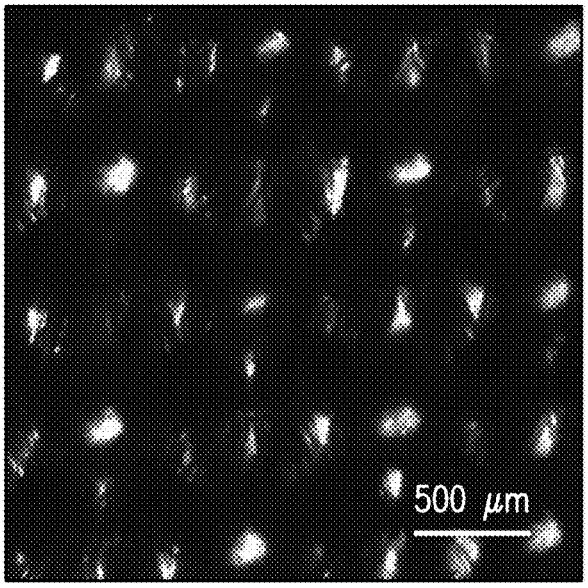
Figure 10D:
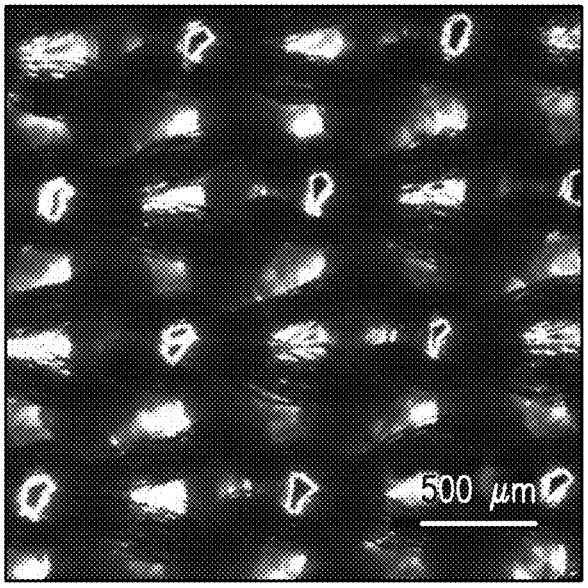
Figure 10E:
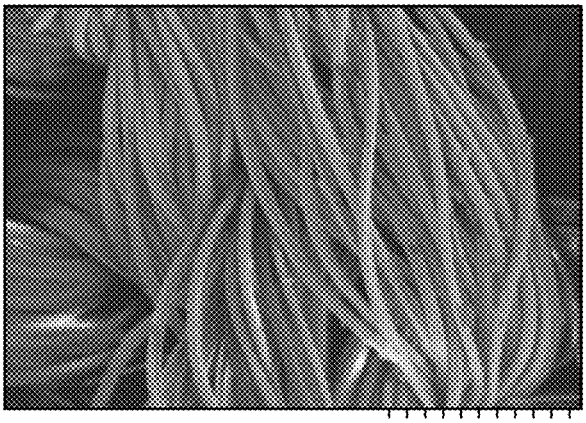

FIGS. 10A-10F show snapshots of the reversible response of a prototypical bimorph MCT fabric between the dry condition (FIG. 10A) and hygroscopic conditions (FIG. 10B). The structure incorporates CNTs as the meta element.

Figure 10F:
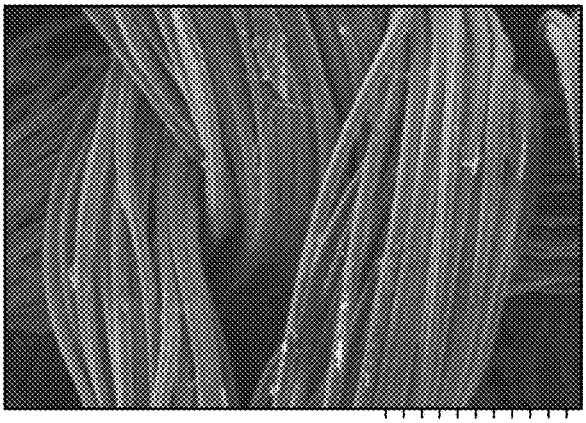

Optical shadow images show the close state (FIG. 10C) with reduced openings between yarns in the fabric and the open state (FIG. 10D) with enlarged openings between yarns in the closed state. Corresponding SEM images reveal the change in the spacing between the base fibers from the closed state (FIG. 10E) to the open state (FIG. 10F). It was clearly observed that the fiber spacing between bimorph MCT fibers was significantly changed between the conditions of the exposure to a low moisture level vs. the elevated moisture level. The experiments provided that the spacing can be controlled quantitatively by changing humidity.

Choices of Meta Elements and their Theoretical IR Response

Theoretical models have been developed to permit evaluation of electromagnetic response of proposed MCT fibers. In accordance with a basic model, a core-shell structure was employed to simulate the MCT base fiber, in which an insulating core was utilized for the base fiber and a conductive layer was coated externally as a fiber shell layer to engineer its optical properties. Furthermore, an MCT yarn was modeled as a periodic array of core-shell structures (MCT fibers), in which the periodic structure is determined by the fabrication process of the MCT yarn.

Gold (Au) was chosen as a conductive shell layer, and $SiO_2$ material was chosen for a fiber core. A finite-difference time-domain (FDTD) simulation method was used to evaluate electromagnetic response of both the single meta fiber and the MCT yarn (formed from a number of individual meta fibers) in the human thermal band regime to validate the developed theoretical models.

Figure 11:
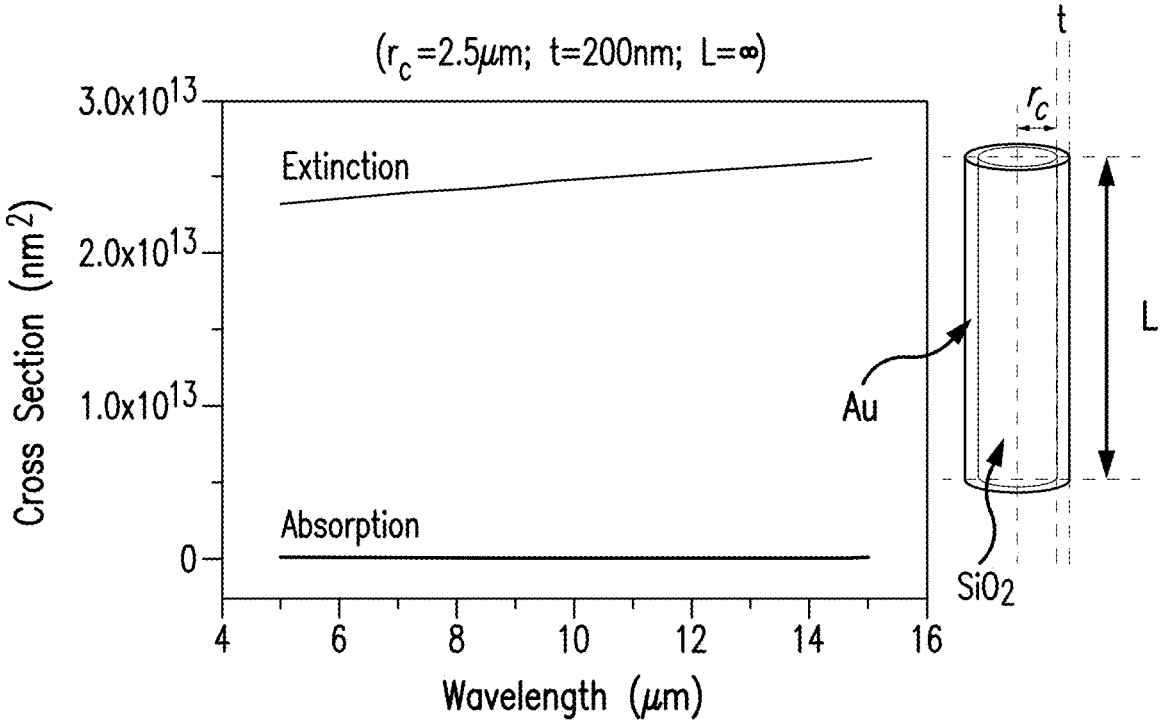
FIG. 11 is a graph representative of FDTD simulation of a single infinitely long $SiO_2$ core-Au shell fiber representative of the meta-coding fiber.

The simulation of the single $SiO_2$ core—Au shell MCT base fiber (presented in FIG. 11) shows that a single base fiber possesses broadband and featureless electromagnetic response and its absorption is very weak (i.e., the extinction of the single $SiO_2$—Au core-shell fiber is dominated by scattering rather than absorption).

However, once the base fibers are organized to form a periodic array (woven into the fabric) their electromagnetic response can be significantly modified due to the coupling of the base fibers.

Figure 12A:
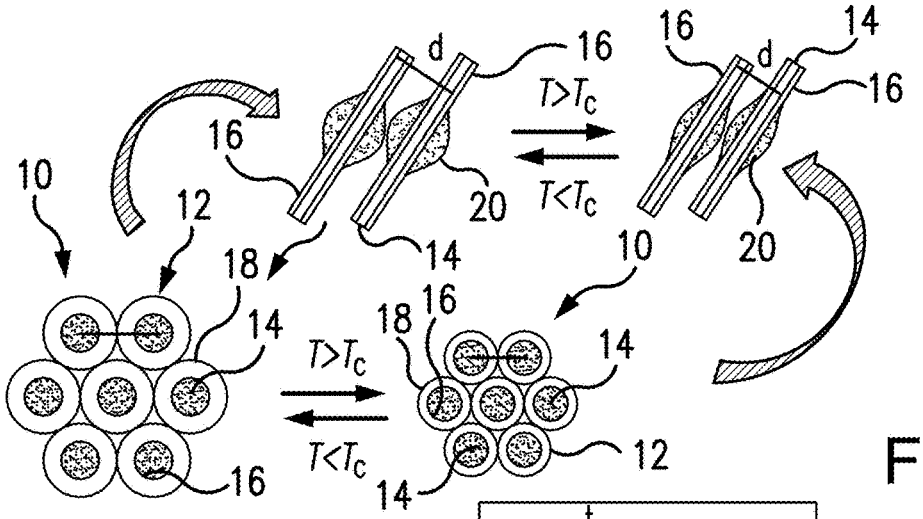
FIG. 12A-12C are graphs of computed emissivity of the close-packed MCT yarn with Au coating, where
Figure 12B:
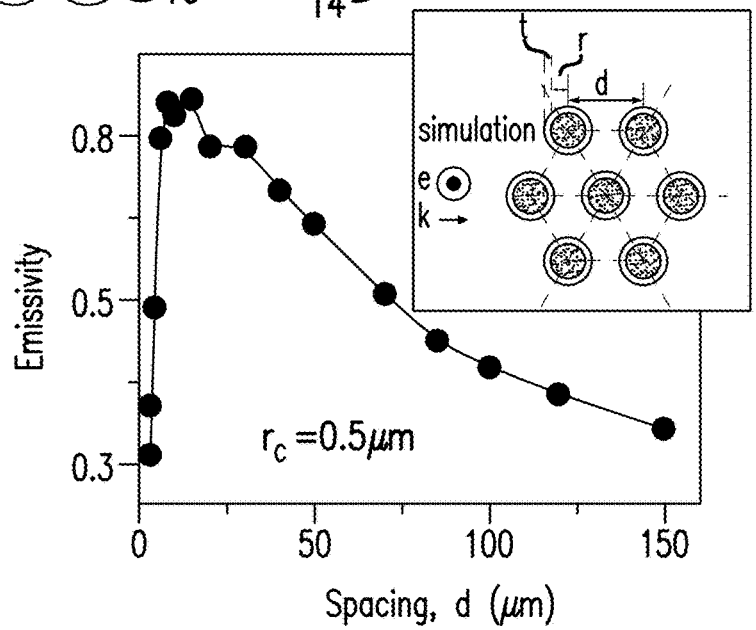
Figure 12C:
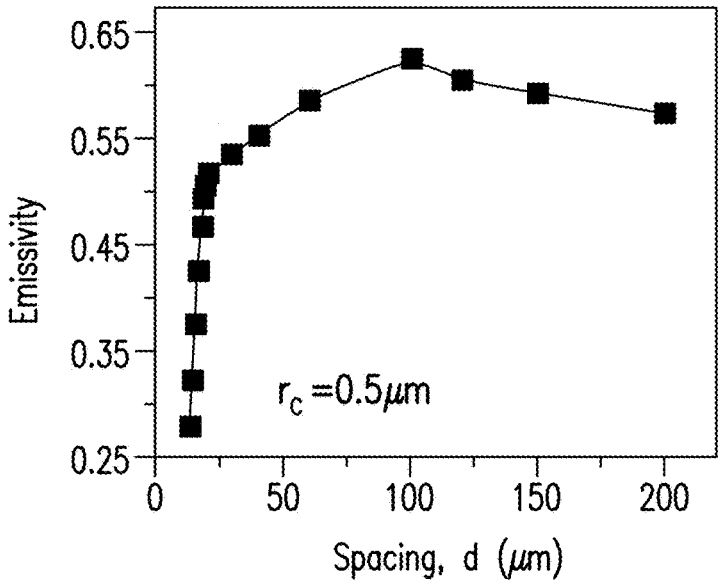

In order to initiate the MCT's operation, a strong resonant absorption peak in the human thermal band regime is required, which depends on the specific arrangement of array. FIGS. 12A-12C show the FDTD emissivity simulation on the model MCT structures involving two different periodic core-shell array structures with different spacing d between the meta fibers. FIG. 12A is representative of the model, FIG. 12B shows the emissivity of the MCT structure with a core diameter of 1 μm and t=200 nm (the Inset shows a schematic model of a hexagonal array in simulation), and FIG. 12C shows the emissivity of the structure with a core diameter of 10 μm and t=200 nm.

Figure 13:
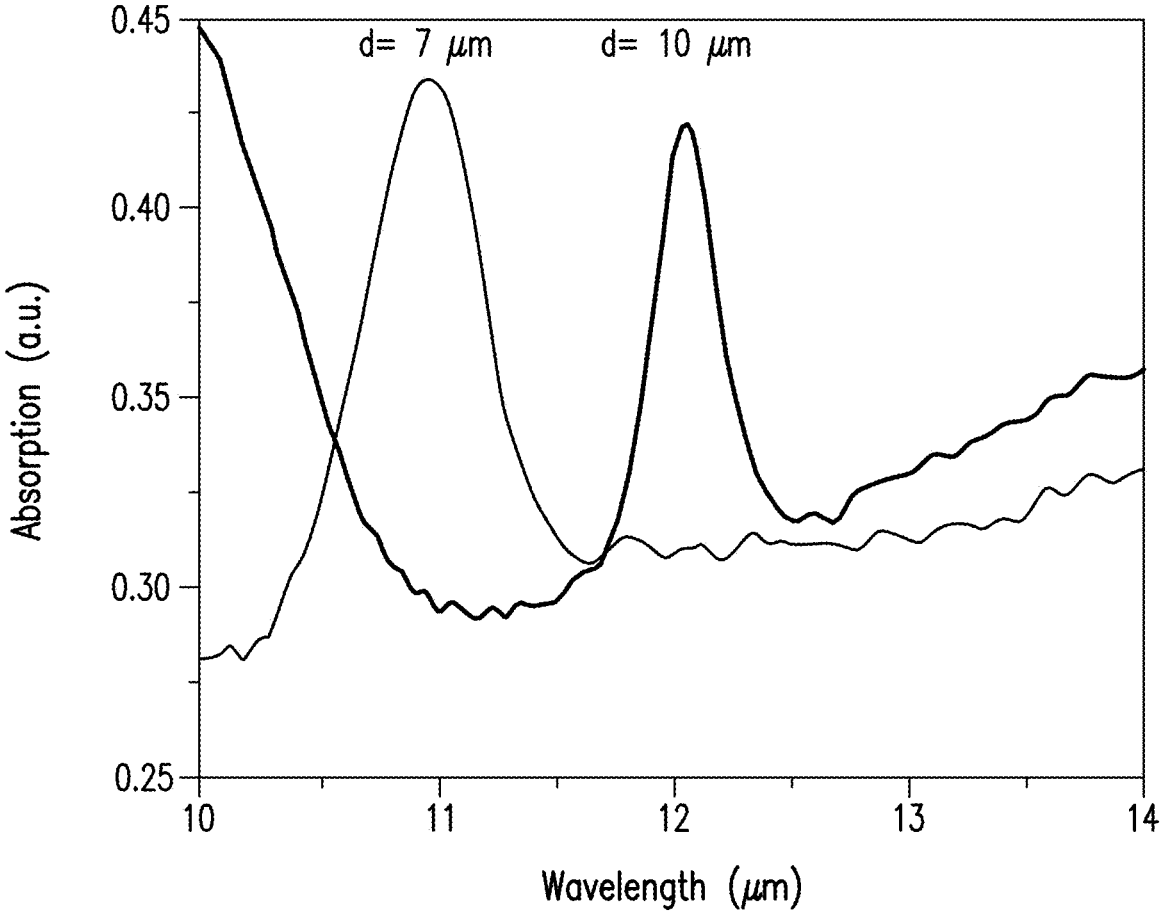
FIG. 13 is a graph diagram representative of the experimental IR (infrared) characteristics of 3D printed hexagonal array with two different spacings, d=7 μm, and d=10 μm, respectively.

The FTIR measurement of two 3D printed structures with different spacing d, as shown in FIG. 13, clearly reflects a strong dependence of IR characteristics on the spacing d between the MCT fibers.

FIG. 13 is representative of the experimental IR characteristics of a 3D printed hexagonal array with two different spacing (d=7 and 10 μm, respectively). In these structures, both have the same 200 nm thick CNT coating, but one structure has a smaller fiber core (1 μm in diameter), and the other structure, has a larger fiber core (10 μm in diameter).

The simulation results clearly show that arrays with smaller fiber cores can provide higher emissivity in resonance. Furthermore, arrays with smaller core size can also offer more sensitive dependence on spacing between meta fibers.

By stretching an MCT yarn, the spacing among MCT constituent fibers within the MCT yarn can also be changed to illustrate the meta coupling-induced tunable infrared properties. FIGS. 14A-14C show a CNT-coated PET yarn 10 that contains 27 fibers 12 of ~10 μm in diameter. The polyester yarns were dip coated by multi-walled CNTs 16, which were stabilized in water by 2 wt % SDS at a concentration less than 0.020 mg/mL, and dried in an oven at about 80° C. for a duration of 1 hour. The mass loading of CNTs was estimated at ~0.8 mg/cm$^2$. By stretching the MCT yarn, the average spacing 26 between fibers can be changed from nearly a close pack to tens of microns. FTIR spectra were then recorded using an ATR accessory.

Figure 15A:
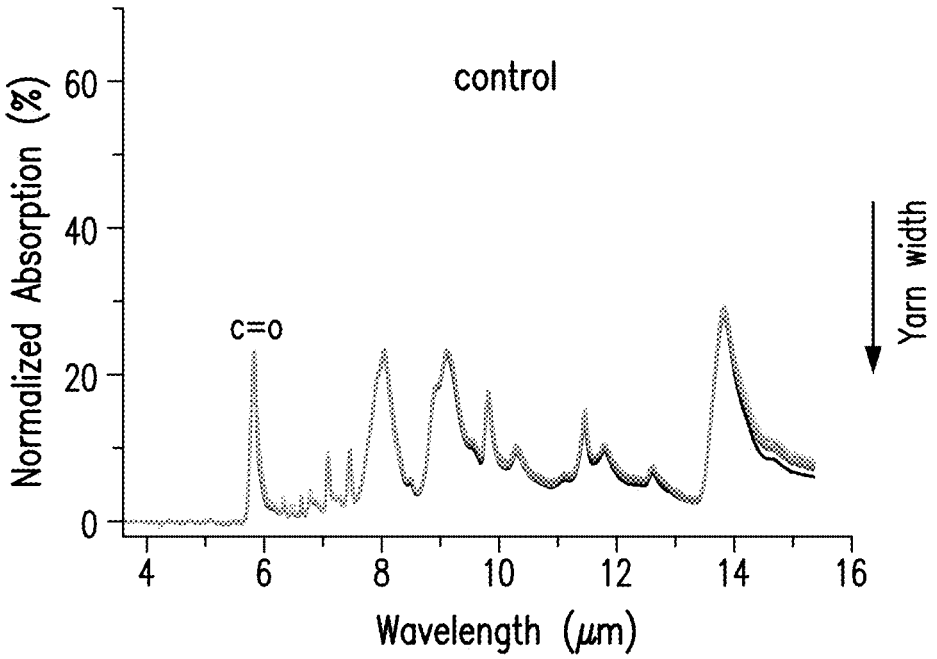
FIGS. 15A-15B are graphs of the FTIR spectra of CNT coated polyester yarns (where a control diagram is shown in FIG. 15A, and the meta-coupling experimental diagram is shown in FIG. 15B).
Figure 15B:
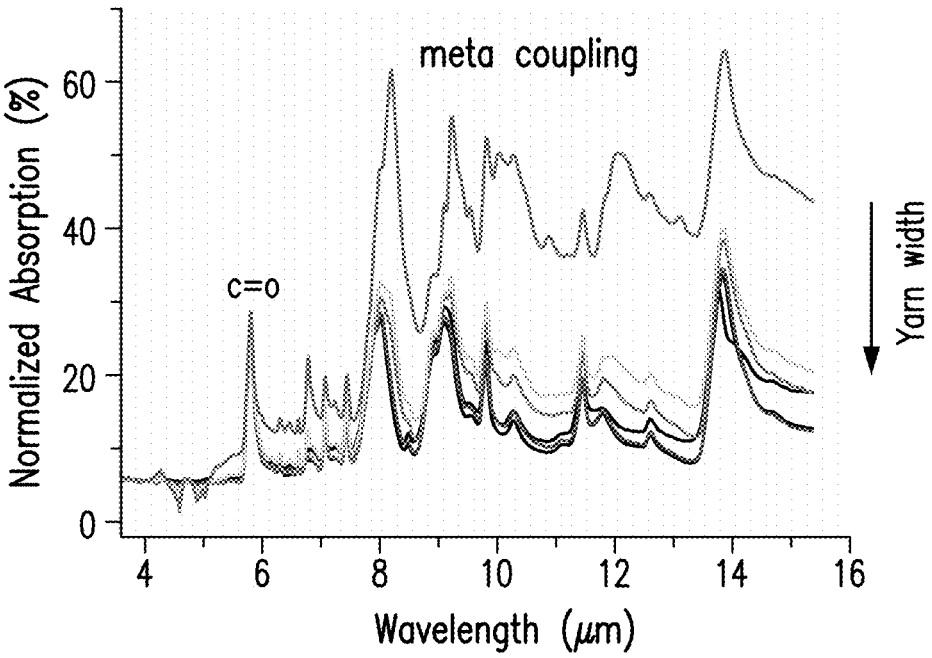

FIGS. 15A-15B are representative of the FTIR spectra of the CNT-coated polyester yarns (FIG. 15B), which show a strong dependence on the fiber spacing between MCT fibers, in correspondence with the control diagram (FIG. 15A).

The sharp peaks presented in the diagram of FIG. 15B are attributed to the IR stretches of the PET (Polyethylene Terephthalate) functional groups, while the broad feature that changes with the yarn width is attributed to the electromagnetic coupling between the meta elements. To facilitate the comparison, the spectra are scaled by the peak intensity of C═O stretch (~1712 cm$^{-1}$) from a yarn with the yarn width of ~370 μm.

As shown in FIG. 15B, the IR absorption increases for the MCT yarns with the width of 144 μm to 370 μm, and reaches its maximum at the yarn width of ~421 μm. Then it begins to decrease even though the yarn width continues to increase up to 633 μm. The intensity variations can be caused by (a) the amount of bonds existing in the material (repetition of that particular functional groups leads to an intense peak), and (b) the polarity of the molecule.

Control experiments (FIG. 15A) show that the infrared spectra of the PET do not depend on the yarn structure and contributions from the SDS and the CNTs are negligible. These experiments suggest that the observed large changes in the infrared spectra arise from electromagnetic coupling among the CNTs in response to the fiber spacing change.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of elements, steps, or processes may be reversed or interposed, all without departing from the spirit or scope of the invention as defined in the appended claims.

What is claimed is:

1. A composite fabric with self-regulated infrared emissivity, comprising:

(a) a plurality of environment responsive meta fibers positioned in a predetermined spaced-apart relationship each with respect to the other with a respective first distance between respective neighboring meta fibers, each of said plurality of meta fibers includes:

a base fiber, an optical structure bonded to said base fiber, thus forming an optical structure-base fiber composite, said optical structure including at least a carbon nanotube (CNT) structure, wherein an electromagnetic coupling between said optical structures on said neighboring of said plurality of meta fibers determines an infrared emissivity of the composite fabric, and an environment responsive mechanism operatively coupled to said optical structure-base fiber composite, said environment responsive mechanism being configured to modulate a distance between said optical structures in accordance with at least one environmental parameter applied to said meta fibers, wherein, when said at least one environmental parameter applied to said plurality of meta fibers deviates from a predetermined environmental parameter zone, said environment responsive mechanism operates to control said first distance between said respective neighboring meta fibers to regulate the electromagnetic coupling between said optical structures bonded thereto, thereby adjusting the infrared emissivity of the composite fabric to decrease said deviation between said applied at least one environmental parameter and said predetermined environmental parameter zone, and wherein said at least one environmental parameter includes moisture level, and wherein said environment responsive mechanism includes a moisture responsive base fiber formed with at least a hydrophobic material part in contact with a hydrophilic material part cooperating to change a relative disposition between said optical structures responsive to the moisture level applied to said composite fabric.

2. The composite fabric of claim 1, wherein said at least one environmental parameter is temperature and said predetermined environmental parameter zone is a predetermined temperature zone, wherein said environment responsive-mechanism includes a temperature responsive polymer layer coated on said optical structure-based fiber composite, wherein said plurality of meta fibers are arranged in a number of yarns, said yarns being arranged in an array thereof and spaced each from the other by a respective second distance between respective neighboring yarns, and wherein, when said applied temperature exceeds said predetermined temperature zone, said temperature responsive polymer layer shrinks, thus decreasing said respective first distance between said neighboring meta fibers and increasing said respective second distance between said respective neighboring yarns, thus increasing the infrared emissivity due to a resonant electromagnetic coupling between said optical structures of said respective neighboring meta fibers and promoting a heat release regime of operation by increasing the air convection through opening in said composite fabric defined by said respective second distance between said respective neighboring yarns.

3. The composite fabric of claim 2, wherein, when said applied temperature falls below said predetermined temperature zone, said temperature responsive polymer layer expands, thus increasing said respective first distance between said respective neighboring meta fibers and decreasing said respective second distance between said respective neighboring yarns, thus decreasing the infrared emissivity due to diminished electromagnetic coupling between said optical structures of said respective neighboring meta fibers and promoting a reduced heat loss regime of operation by decreasing the air convection through openings in said composite fabric defined by said respective second distance between said respective neighboring yarns.

4. The composite fabric of claim 1, wherein said optical structure further includes at least one selected from a group consisting of carbon nanohorns, carbon fibers, graphene, graphene oxides, silver nanowires, copper nanowires, silicon nanowires, gold nanowires, gold nanoparticles, conductive nanomaterials, thin films, surfactant stabilized aqueous solutions of CNTs, and combinations thereof.

5. The composite fabric of claim 2, wherein said temperature responsive polymer includes a polymer selected from a group consisting of:

poly(N-isopropylacrylamide, hydroxypropyl cellulose, poly(vinylcaprolactame), polyvinyl methyl ether, polyethylene oxide, polyvinylmethylether, polyhydroxyethylmethacrylate, poly(N-acryloylglycinamide), ureido-functionalized polymers, copolymers from N-vinylimidazole and 1-vinyl-2-(hydroxylmethyl)imidazole, copolymers from acrylamide and acrylonitrile, derivatives thereof, and combinations thereof.

6. The composite fabric of claim 1, wherein said base fiber is formed from at least one fiber selected from a group consisting of:

natural fibers, cotton, silk, linen, cellulose fibers, Polyethylene Terephthalate (PET), nylons, glass based fibers, and combinations thereof.

7. The composite fabric, of claim 2 wherein a thickness of said temperature responsive polymer layer falls in a range selected from a group of ranges consisting of: 2 μm-10 μm, 1 μm-15 μm, 0.1 μm-30 μm, and 0.1 μm-50 μm.

8. The composite fabric of claim 5, wherein said temperature responsive polymer layer includes poly(N-isopropylacrylamide), and wherein the weight of said CNT structure falls in the range selected from a group consisting of: 0.025-1.5%, 0.05-0.5%, and 0.1-0.25% of the weight of said composite fabric.

9. The composite fabric of claim 1, wherein said optical structure is covered on said base fiber or embedded into said base fiber.

10. The composite fabric of claim 2, wherein said composite fabric is a textile for clothing, and wherein said predetermined temperature zone is a human temperature comfort zone.

11. The composite fabric of claim 2, wherein said predetermined temperature zone is a lower critical solution temperature (LCST) for said temperature responsive polymer.

12. The composite fabric of claim 2, wherein said temperature responsive polymer layer includes polymer beads having a diameter in the range of 0-15 μm.

13. A composite fabric with self-regulated infrared emissivity, comprising:

a plurality of environment-responsive bimorph meta fibers arranged in a number of yarns and positioned in a predetermined spaced-apart relationship one with respect to another with a first distance defined between respective neighboring bimorph meta fibers within a respective yarn, wherein said number of yarns are arranged in an array with a second distance defined between respective neighboring yarns;

wherein each bimorph meta fibers includes:

a moisture responsive core fiber, said core fiber being a single fiber containing cooperating at least a hydrophilic material and a hydrophobic material, and an optical structure containing at least a carbon nanotube (CNT) structure bonded to said core fiber;

wherein an electromagnetic coupling between said optical structures on said respective neighboring of said plurality of bimorph meta fibers determines an infrared emissivity of the composite fabric;

wherein, when a moisture and temperature applied to said composite fabric exceeds a predetermined temperature and moisture zone, respectively, said core fiber changes configuration thereof to increase said second distance between said respective neighboring yarns and to reduce said first distance between said respective neighboring bimorph meta fibers in a respective yarn, thereby controllably increasing electromagnetic coupling between said optical structures on said respective neighboring bimorph meta fibers, thus adjusting the infrared emissivity of the composite fabric, and promoting a heat and moisture release regime through the increased distance between said respective neighboring yarns by increasing the moisture evaporation, air convection, and heat/moisture release, thereby reducing said applied moisture and temperature to said predetermined temperature and moisture zone.

14. The composite fabric of claim 13, wherein said hydrophilic material is diacetate or cellulose, and said hydrophobic material is triacetate.

15. The composite fabric of claim 13, wherein said core fiber is formed from cellulose and triacetate in weight proportion of approximately 50%:50%.

16. The composite fabric of claim 13, wherein, when the moisture and temperature applied to said composite fabric is lower than the predetermined temperature and moisture zone, said first distance between said respective neighboring bimorph meta fibers in said respective yarn increases, thereby decreasing electromagnetic coupling between said optical structures on said respective neighboring bimorph meta fibers, thus adjusting the infrared emissivity of the composite fabric to reduce the loss of moisture and heat.

* * * * *